US009310086B2

(12) United States Patent
Motomura et al.

(10) Patent No.: US 9,310,086 B2
(45) Date of Patent: Apr. 12, 2016

(54) AIR-CONDITIONING APPARATUS

(75) Inventors: Yuji Motomura, Tokyo (JP); Koji Yamashita, Tokyo (JP); Hiroyuki Morimoto, Tokyo (JP); Shinichi Wakamoto, Tokyo (JP); Naofumi Takenaka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 614 days.

(21) Appl. No.: 13/501,325

(22) PCT Filed: Oct. 29, 2009

(86) PCT No.: PCT/JP2009/068554

§ 371 (c)(1),
(2), (4) Date: Apr. 11, 2012

(87) PCT Pub. No.: WO2011/052055

PCT Pub. Date: May 5, 2011

(65) Prior Publication Data

US 2012/0198879 A1 Aug. 9, 2012

(51) Int. Cl.
*F25D 27/00* (2006.01)
*F24F 3/06* (2006.01)
(Continued)

(52) U.S. Cl.
CPC ..... *F24F 3/065* (2013.01); *F25B 13/00* (2013.01); *F25B 25/005* (2013.01);
(Continued)

(58) Field of Classification Search
CPC ..... F25B 25/00; F25B 25/005; F25B 7/00; F25B 2313/023; F25B 13/00; F25B 2313/0293; F25B 2313/0313; F25B 2313/0312; F24F 11/001; F24F 11/0079
USPC ..... 62/324.1, 324.6, 498, 238.7
See application file for complete search history.

(56) References Cited

U.S. PATENT DOCUMENTS 5,249,432 A * 10/1993 Ichikawa ..... 62/197
5,297,392 A * 3/1994 Takata et al. ..... 62/160
(Continued)

FOREIGN PATENT DOCUMENTS

JP 61-76852 A 4/1986
JP 4-359767 A 12/1992
(Continued)

OTHER PUBLICATIONS

*International Search Report (PCT/ISA/210) issued on Jan. 26, 2010, by Japanese Patent Office as the International Searching Authority for International Application No. PCT/JP2009/068554.

*Primary Examiner* — Ljiljana Ciric
*Assistant Examiner* — Kirstin Oswald
(74) *Attorney, Agent, or Firm* — Buchanan Ingersoll & Rooney PC

(57) ABSTRACT

An air-conditioning apparatus including an outdoor unit having a compressor for compressing a refrigerant and a heat source side heat exchange for exchanging heat between the refrigerant and air, a plurality of indoor units having use side heat exchangers for exchanging heat between a heat transfer medium that flows therein and air, and relay unit disposed between the outdoor unit and the indoor units. The relay unit exchanges heat between the refrigerant conveyed from the outdoor unit and the heat transfer medium flowing in the indoor units. The relay unit includes a main relay unit that is connected to the outdoor unit with two pipes and a sub relay unit that is connect to the main relay unit with three pipes.

8 Claims, 9 Drawing Sheets

(51) Int. Cl.
*F25B 13/00* (2006.01)
*F25B 25/00* (2006.01)

(52) U.S. Cl.
CPC .... *F25B 2313/006* (2013.01); *F25B 2313/007* (2013.01); *F25B 2313/0231* (2013.01); *F25B 2313/0272* (2013.01); *F25B 2313/02732* (2013.01)

(56) References Cited

U.S. PATENT DOCUMENTS 5,388,422 A * 2/1995 Hayashida et al. ..... 62/211
6,131,401 A * 10/2000 Ueno et al. ..... 62/175
2003/0230096 A1* 12/2003 Hwang, II ..... 62/160
2004/0134215 A1* 7/2004 Park et al. ..... 62/324.1
2008/0196432 A1* 8/2008 Shimamoto et al. ..... 62/238.7

FOREIGN PATENT DOCUMENTS

JP 5-280818 A 10/1993
JP 2001-289465 A 10/2001
JP 2002-106995 A 4/2002
JP 2003-343936 A 12/2003
JP 2004-53069 A 2/2004
JP 2004-226015 A 8/2004
JP 2005-140444 A 6/2005

* cited by examiner

AIR-CONDITIONING APPARATUS

TECHNICAL FIELD

The present invention relates to an air-conditioning apparatus that is capable of efficiently supplying heating energy, cooling energy, or both the heating energy and the cooling energy generated in a heat source device for a plurality of air conditioning loads, and relates to an apparatus used, for example, in multi-air-conditioning apparatuses for buildings.

BACKGROUND ART

Conventional air-conditioning apparatuses used in multi-air-conditioning apparatuses for buildings condense and heat or decompress and cool refrigerants, such as HFC (Hydrofluorocarbon), using a heat source device, such as an outdoor unit arranged outdoors. Further, the refrigerant is conveyed to an indoor unit, which is arranged indoors and is connected to the outdoor unit, through extension pipings. The refrigerant exchanges heat with the indoor air in the indoor unit, carries out a cooling operation with the refrigerant receiving heat, and carries out a heating operation with the refrigerant releasing heat.

There is a chiller system that carries out a cooling operation or a heating operation by heating or cooling a heat tranfers medium, such as water or brine that is conveyed into the outdoor unit, using a heat source device, such as an outdoor unit, and by supplying the heat tranfers medium to an indoor unit or a heat releasing/receiving device that are connected to the outdoor unit. Refer to reference Patent Literature 1 to 4, for example.

CITATION LIST

Patent Literature

Patent Literature 1: Japanese Unexamined Patent Application Publication No. 2005-140444 (page 4, FIG. 1, etc.)

Patent Literature 2: Japanese Unexamined Patent Application Publication No. 5-280818 (pages 4 and 5, FIG. 1, etc.)

Patent Literature 3: Japanese Unexamined Patent Application Publication No. 2001-289465 (pages 5 to 8, FIG. 1, FIG. 2, etc.)

Patent Literature 4: Japanese Unexamined Patent Application Publication No. 2003-343936 (page 5, FIG. 1)

SUMMARY OF INVENTION

Technical Problem

Conventional air-conditioning apparatuses used in multi-air-conditioning apparatuses for buildings carry out a cooling operation or a heating operation by circulating, in a plurality of indoor units, a heated or cooled refrigerant that has been supplied from the heat source device of an outdoor unit to the indoor units. Accordingly, when there is a leakage of the refrigerant into an indoor unit, there is a possibility that the entire amount of the refrigerant that is required in all of the indoor units, which are connected to the outdoor unit, leak into the room arranged with the indoor unit from the leaking portion.

Further, conventional air-conditioning apparatuses used in multi-air-conditioning apparatuses for buildings is capable of using the refrigerant in a different manner such as a refrigerant for cooling an indoor unit and as a refrigerant for heating an indoor unit by using an outdoor-indoor relay unit, and is capable of connecting a plurality of outdoor-indoor relay units in parallel. However, the entire amount of refrigerant corresponding to the number of outdoor-indoor relay unit connected to the outdoor unit and of the indoor units is required, and when a refrigerant leakage occurs, there is a possibility that the entire amount of the refrigerant will leak into the room through the leaking portion.

Furthermore, in the chiller system carrying out the heating operation or the cooling operation by heating or cooling the heat tranfers medium, such as water or brine, with the heat source device in the outdoor unit and by conveying the heat tranfers medium to an indoor unit using a heat tranfers medium conveying device, when a plurality of indoor units with a long distance to the outdoor unit are connected to the outdoor unit, much power to convey the heated or cooled heat tranfers medium to the indoor units will be required. Thus, the chiller system consumes greater power and is inferior in energy efficiency compared with the conventional air-conditioning apparatuses used in multi-air-conditioning apparatuses for buildings that carry out cooling operation/heating operation by conveying refrigerant to the indoor units.

The invention has been made to obtain an air-conditioning apparatus that is capable of preventing refrigerant leakage on the indoor side by carrying out a heating operation or cooling operation conveying a heat tranfers medium, such as water or brine, to the indoor units, and, furthermore, reducing conveyance power more than before. Additionally, the invention can obtain an air-conditioning apparatus that is capable of connecting the same number of indoor units as that of conventional apparatuses.

Solution to Problem

An air-conditioning apparatus or the present invention includes:

- an outdoor unit including a compressor compressing and conveying a refrigerant, a first refrigerant flow switching device switching passages conveying the refrigerant, and a heat source side heat exchanger exchanging heat between an air and the refrigerant;
- a plurality of indoor units each including a use side heat exchanger that exchanges heat between air and a heat tranfers medium, the heat tranfers medium flowing in the use side heat exchangers; and
- a relay unit disposed between the outdoor unit and the indoor units, the relay unit exchanging heat between the refrigerant conveyed from the outdoor unit and the heat tranfers medium.

The relay unit includes

- a main relay unit that includes at least one main-unit expansion device controlling the pressure of the refrigerant, the main relay unit connected to the outdoor unit with a refrigerant piping, and
- one or more sub relay units connected to the main relay unit with a refrigerant piping, the one or more sub relay units including: a plurality of heat exchangers related to heat tranfers medium each exchanging heat between the refrigerant and the heat tranfers medium; a plurality of second refrigerant flow switching devices each switching passages of the refrigerant conveyed from the main relay unit; a plurality of sub-unit expansion devices each controlling a pressure of the refrigerant; a plurality of heat tranfers medium conveying devices each conveying the heat tranfers medium that has exchanged heat with the refrigerant in the corresponding heat exchanger related to heat tranfers medium to the indoor units, which are connected to the plurality of heat tranfers medium conveying devices through a heat tranfers medium piping; a plurality of heat tranfers medium flow switching devices each disposed in a counter position to the inlet side and outlet side of the corresponding indoor unit in which the heat tranfers medium flows, the heat tranfers medium flow switching devices each selecting a passage of the heat tranfers medium, which flows in the indoor unit, among the heat exchangers related to heat tranfers medium; and a plurality of heat tranfers medium flow control devices each disposed in a counter position to the inlet side or the outlet side of the corresponding indoor unit in which the heat tranfers medium flows, the heat tranfers medium flow control devices each controlling a flow rate of the heat tranfers medium.

In the above air-conditioning apparatus, the outdoor unit and the main relay unit are connected with two pipings, and the main relay unit and each of the one or more sub relay units are connected with three pipings.

Advantageous Effects of Invention

The air-conditioning apparatus of the invention exchanges heat between the refrigerant and the heat tranfers medium, such as water or brine, through the sub relay units without directly circulating the refrigerant in the room where the indoor unit is arranged in, and achieves heating operation/cooling operation by conveying the heat tranfers medium to the indoor unit. Accordingly, even if there is a refrigerant leakage, refrigerant leakage into the room can be prevented. Further, by conveying the refrigerant from the outdoor unit to the main relay unit and to the sub relay units, the sub relay units can be arranged at appropriate positions, and, thus, the conveyance distance of the heat tranfers medium can be shortened. With this, the power generated by the heat tranfers medium conveying device, such as a pump, can be reduced, and energy saving can be achieved.

Further, by providing a gas-liquid separator in the main relay unit, it will be possible to convey the separated gas and liquid refrigerant to the sub relay units, and to supply either the gas or liquid refrigerant to the plurality of sub relay units.

Furthermore, when a plurality of sub relay units are connected, it will be possible to operate each sub unit such that the heat exchange between the heat tranfers medium and the refrigerant is carried out according to the load of the indoor units connected to the sub unit, and it will be possible to have the outdoor unit operate in cooling operation mode or heating operation mode in accordance with the total load of each sub relay unit. Hence, it is possible to carry out a cooling and heating mixed operation with the indoor units that is connected to each sub relay unit.

BRIEF DESCRIPTION OF DRAWINGS

FIG. 6 is a system circuit diagram during a heating only operation while a plurality of sub relay units are connected.

FIG. 7 is a system circuit diagram during a cooling only operation while a plurality of sub relay units are connected.

FIG. 8 is a system circuit diagram during a cooling main operation while a plurality of sub relay units are connected.

FIG. 9 is a system circuit diagram during a heating main operation while a plurality of sub relay units are connected.

DESCRIPTION OF EMBODIMENT

Figure 1:
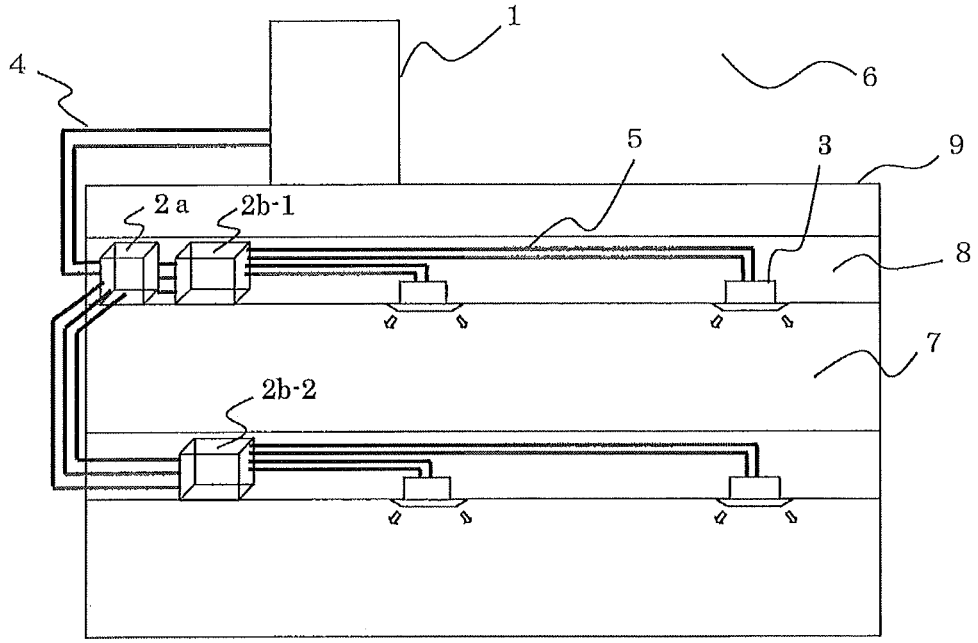
FIG. 1 is a general drawing of an air-conditioning apparatus according to Embodiment of the invention, and is a system configuration diagram when a plurality of indoor units is connected thereto.

Embodiment of the invention will be described below with reference to the drawings. FIG. 1 is a general drawing of an air-conditioning apparatus according to Embodiment of the invention, and is a system configuration diagram when a plurality of indoor units is connected thereto. Here, a single main relay unit 2*a* and a plurality of sub relay units 2*b*-1 and 2*b*-2 are connected in-between a heat source device (or an outdoor unit) and indoor units 3. Note that, hereinafter, the sub relay units 2*b*-1 and 2*b*-2 may be referred to as just "relay units 2*b*". The main relay unit 2*a* is arranged in a space, such as a shared space or a space above a ceiling, in a structure, such as a building, and the main relay unit 2*a* is connected to the outdoor unit with refrigerant pipings 4. In addition, the sub relay units 2*b*-1 and 2*b*-2 are arranged in plural numbers in a space, such as a shared space or a space above a ceiling, in a structure, such as a building, for example, and are connected to the main relay unit 2*a* with refrigerant pipings 4. The sub relay units are not limited to the one-in-each-floor arrangement as shown in FIG. 1, but are arranged such that the number is in relation to the number of connected indoor units in order to be capable of responding to the load in the indoor spaces that is to be air-conditioned. These sub relay units 2*b*-1 and 2*b*-2 are connected to the indoor units 3 with heat tranfers medium pipings 5 in which heat tranfers medium , such as water or brine, flows therein.

Next, with reference to FIG. 1, an operation of an air-conditioning apparatus of the invention will be briefly described. The refrigerant is conveyed from an outdoor unit 1 to the main relay unit 2*a* through refrigerant pipings 4, is separated into gas and liquid in the main relay unit 2*a*, and is conveyed to a plurality of sub relay units 2*b*-1 and 2*b*-2 through refrigerant pipings 4. The refrigerant that has been conveyed exchanges heat with the heat medium, such as water or brine, in heat exchangers related to heat tranfers medium (described later) in the sub relay units 2*b*-1 and 2*b*-2, and hot water or cold water is generated. The hot or cold water generated in the sub relay units 2*b*-1 or 2*b*-2 is conveyed by the heat tranfers medium conveying device to the indoor units 3 through the heat tranfers medium pipings 5, and is used in the indoor units 3 in a heating operation or a cooling operation for an indoor space 7.

With the configuration of the air-conditioning apparatus in FIG. 1, it is possible to arrange the sub relay units 2*b* in plural numbers in different places in a floor of a structure, such as a building, as illustrated in FIG. 1, for example, because the outdoor-indoor relay unit is separated into the main relay unit 2*a* and the sub relay units 2*b*. Accordingly, the sub relay units 2*b* can be arranged so that the indoor units 3 are arranged within the range of the conveyance limit of the heat tranfers medium conveying device which the sub relay units 2*b* is provided with.

Further, as shown in FIG. 1, since after the refrigerant that has been conveyed from the outdoor unit 1 is separated into gas and liquid by the main relay unit 2*a* and the refrigerant is conveyed to the sub relay units 2*b*, it is possible to simultaneously supply the refrigerant required for the load in the sub relay units 2*b*. Furthermore, waste heat recovered from the one of the sub relay unit 2*b*-1 may be supplied to the other sub relay unit 2*b*-2. In addition, the heating operation and the cooling operation can be carried out simultaneously in the plurality of indoor units 3 by supplying hot water and cold water simultaneously from the sub relay units 2*b* to the indoor units 3.

As regards the refrigerant for the heat source side, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used.

As regards the heat tranfers medium, for example, water, brine, a mixed solution of brine and water, or a mixed solution of water and an additive with high anticorrosive effect can be used.

Figure 2:
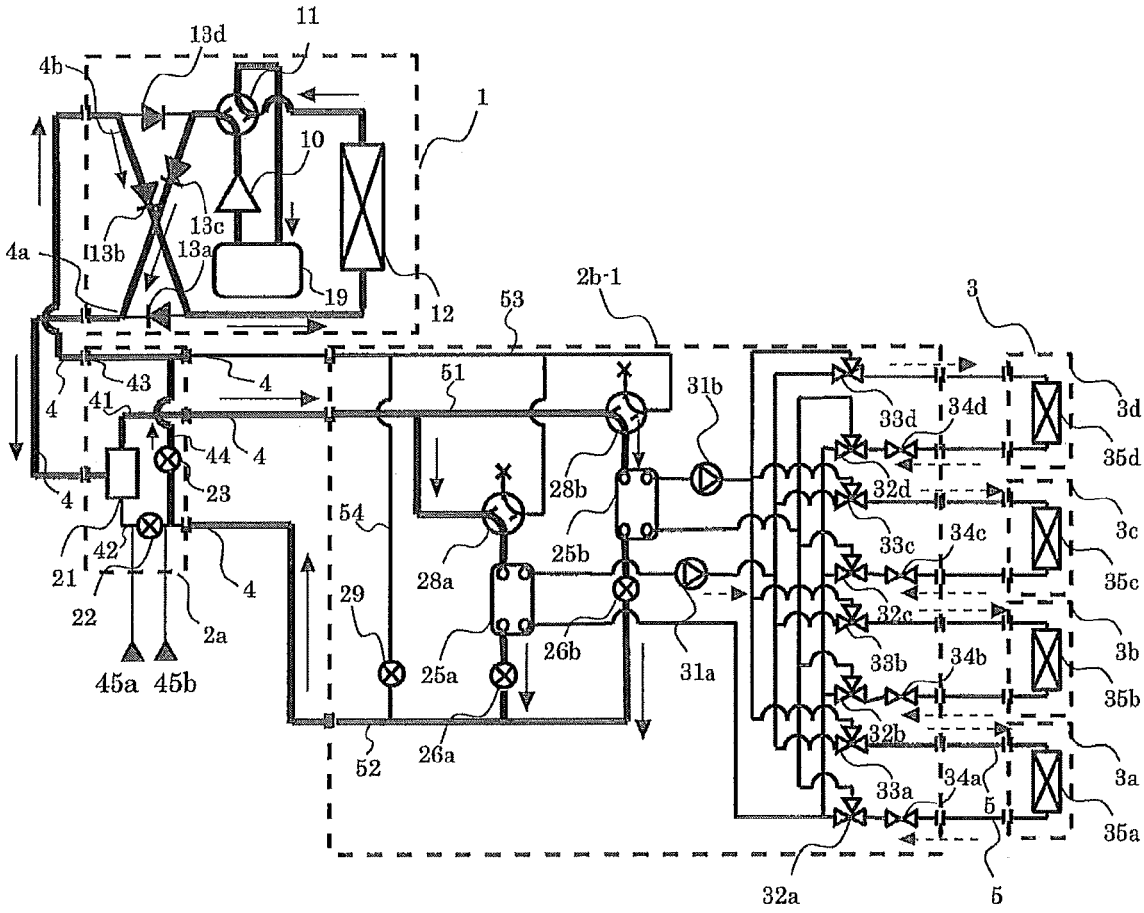
FIG. 2 is a system circuit diagram, which is among system circuit diagrams of the air-conditioning apparatus according to Embodiment of the invention, during a heating only operation.

FIG. 2 is a system circuit diagram (refrigerant circuit diagram) illustrating an exemplary configuration of the air-conditioning apparatus according to Embodiment of the invention. The operation of this air-conditioning apparatus will be described with reference to FIG. 2. The outdoor unit 1 and the main relay unit 2*a* are connected with refrigerant pipings 4, and the main relay unit 2*a* and the sub relay unit 2*b*-1 are connected through heat exchangers related to heat tranfers medium 25*a* and 25*b*, which is provided in the sub relay unit 2*b*-1, with refrigerant pipings 4. Further, the sub relay unit 2*b*-1 and the indoor units 3 are connected through heat exchangers related to heat tranfers medium 25*a* and 25*b*, which is provided in the sub relay unit 2*b*-1, with heat tranfers medium pipings 5.

(Outdoor Unit 1)

The outdoor unit 1 is configured with, as its basic elements, a compressor 1 for compressing the refrigerant to a high-temperature high-pressure state and for conveying the refrigerant to the refrigerant channel, a first refrigerant flow switching device 11, such as a four-way valve, that switches the refrigerant flow and the operation mode of the outdoor unit based on the heating operation mode and the cooling operation mode, and a heat source side heat exchanger 12 that functions as an evaporator during the heating operation and as a condenser during the cooling operation. Note that it is preferable that an accumulator 19 is provided that stores excessive refrigerant caused by the difference between the heating operation mode and the cooling operation mode or excessive refrigerant during change in the transitional operation. Each of the above elements is connected in series with the refrigerant piping 4. Further, provided in the outdoor unit 1 are refrigerant connecting pipings 4*a* and 4*b*, and check valves 13*a*, 13*b*, 13*c*, and 13*d* to allow the refrigerant to flow in only one direction. By providing the refrigerant connecting pipings 4*a* and 4*b*, and the check valves 13*a*, 13*b*, 13*c*, and 13*d* in the outdoor unit 1, the refrigerant flowing into the main relay unit 2*a* and the sub relay units 2*b* can be fixed to a single direction regardless of the operation modes of the indoor units 3.

(Indoor Units 3)

Each of the indoor units 3 is provided with each of the corresponding use side heat exchangers 35 (35*a* to 35*d*), and are connected to each of the corresponding heat tranfers medium flow control devices 34 (34*a* to 34*d*) and heat tranfers medium flow switching devices 33 (33*a* to 33*d*) in the sub relay units 2*b* with heat tranfers medium pipings 5. In each of the use side heat exchangers 35, the heat tranfers medium supplied from the sub relay unit 2*b*-1 flow therein, and in each of the indoor units 3, heat is exchanged between air supplied from an air-sending device (not illustrated), such as a fan, with the heat tranfers medium, and supplies air for heating or air for cooling into the indoor space 7.

Note that in FIG. 2, four indoor units 3 are connected to the sub relay units 2*b* and four use side heat exchangers 35 are connected to each of the indoor units 3, but the number is not limited to four and can be determined appropriately (Main Relay Unit 2*a*)

The main relay unit 2*a* includes a gas-liquid separator 21 that takes in the refrigerant conveyed from the outdoor unit 1, separates the refrigerant into gas and liquid, and sends them out; and a refrigerant return passage for returning the refrigerant returning from the sub relay units 2*b* to the outdoor unit 1. Note that the passage in which the gas refrigerant that has been separated in the gas-liquid separator 21 flows through is referred to as a main-unit first refrigerant passage 41, the passage in which the liquid refrigerant that has been separated in the gas-liquid separator flows through via a main-unit expansion device (first expansion device 22) is referred to as a main-unit second refrigerant passage 42, and the passage in which the refrigerant returning from the sub relay unit 2*b*-1 flows through is referred to as a main-unit third refrigerant passage 43.

Furthermore, the main-unit second refrigerant passage 42 and the main-unit third refrigerant passage are connected by a main-unit bypass passage 44 via another main-unit expansion device (second expansion device 23).

Additionally, before and after the first expansion device 22 in the main relay unit 2*a*, a first pressure detection device 45*a* and a second pressure detection device 45*b* is provided for control use.

(Sub Relay Units 2*b*)

Each of the sub relay units 2*b* includes two heat exchangers related to heat tranfers medium 25 (here, 25*a* and 25*b*). The heat exchangers related to heat tranfers medium 25 exchanges heat between the refrigerant on the heat source side and heat tranfers medium on the use side, and transfer a cooling energy or a heating energy generated in the outdoor unit 1 and stored in the heat source side refrigerant to the heat medium. Thus, the heat exchangers related to heat tranfers medium 25 functions as condensers (radiator) when supplying heated heat tranfers medium to the indoor unit 3 under heating operation, and functions as an evaporator when supplying cooled heat tranfers medium to the indoor unit 3 under cooling operation. The heat exchanger related to heat tranfers medium 25*a* is disposed between a third refrigerant expansion device 26*a* and a second refrigerant flow switching device 28*a*, and is used to cool the heat tranfers medium in a cooling only operation and a cooling and heating mixed operation mode. Additionally, the heat exchanger related to heat tranfers medium 25*b* is disposed between a third refrigerant expansion device 26*b* and a second refrigerant flow switching device 28*b*, and is used to heat the heat tranfers medium in a heating only operation and the cooling and heating mixed operation mode.

Note that as regards each of the third refrigerant expansion device 26*a* and the third refrigerant expansion device 26*b*, for example, an electronic expansion valve and the like that can variably control its opening degree is preferable.

As regards each of the second refrigerant flow switching device 28*a* and the second refrigerant flow switching device 28*b*, a four-way valve is used, for example, and in accordance with the operation mode of the indoor units 3 (3*a* to 3*d*), switches the refrigerant passages so that the heat exchangers related to heat tranfers medium 25*a* and 25*b* functions as a condenser or an evaporator. The second refrigerant flow switching device 28*a* is disposed on the downstream side of the heat exchanger related to heat tranfers medium 25*a*, downstream regarding the flow during the cooling operation, and the second refrigerant flow switching device 28*b* is disposed on the downstream side of the heat exchanger related to heat tranfers medium 25*b*, downstream regarding the flow during the cooling operation.

Each of the second refrigerant flow switching devices 28*a* and 28*b* is connected such that switching between the main-unit first refrigerant passage 41 and the refrigerant return passage of the main-unit third refrigerant passage 43 can be performed.

The opposite side of each heat exchanger related to heat tranfers medium 25*a* and 25*b* to each third refrigerant expansion devices 26*a* and 26*b* is connected to the main-unit second refrigerant passage 42.

Note that the passage connecting the second refrigerant flow switching devices 28*a* and 28*b* to the main-unit first refrigerant passage 41 is referred to as a sub-unit first refrigerant passage 51, the passage connecting the third expansion devices 26*a* and 26*b* to the main-unit second refrigerant passage 42 is referred to as a sub-unit second refrigerant passage 52, and the refrigerant return passage in which the refrigerant returning to the main relay unit 2*a* flows through is referred to as a sub-unit third refrigerant passage 53.

Further, the sub-unit second refrigerant passage 52 and the sub-unit third refrigerant passage 53 are connected with a sub-unit bypass passage 54 via a fourth expansion device 29. As regards the fourth expansion device 29, an expansion device that controls the opening area of the passage may be used, or an on-off device that opens and closes the passage may be used. When an expansion device is used as the fourth expansion device 29, it will be possible to control the amount of refrigerant flowing in the sub-unit bypass passage 54 between the sub-unit second refrigerant passage 52 and the sub-unit third refrigerant passage 53 by controlling the opening degree depending on the operation state, and it will be possible to control in a more fine manner compared to when using an on-off device.

heat tranfers medium flow switching devices 32 (32*a* to 32*d*) and heat tranfers medium flow switching devices 33 (33*a* to 33*d*) constituted by a three-way valve or the like are each disposed in the sub relay units 2*b* so as to correspond to each of the indoor units 3 (3*a* to 3*d*) to convey the heat tranfers medium to the indoor units 3. Each of the heat tranfers medium flow switching devices 32 is disposed on an outlet side of a heat tranfers medium passage of the corresponding use side heat exchanger 35 such that one of the three ways is connected to the heat exchanger related to heat tranfers medium 25*a*, another one of the three ways is connected to the heat exchanger related to heat tranfers medium 25*b*, and the other one of the three ways is connected to the heat tranfers medium flow control device 34. Each of the heat tranfers medium flow switching device 33 is disposed on an inlet side of the heat tranfers medium passage of the corresponding use side heat exchanger 35 such that one of the three ways is connected to the heat exchanger related to heat tranfers medium 25*a*, another one of the three ways is connected to the heat exchanger related to heat tranfers medium 25*b*, and the other one of the three ways is connected to the use side heat exchanger 35. These heat tranfers medium flow switching devices 32 and 33 are disposed in the same number as the disposed number of the indoor units 3, and switch the passage of the heat tranfers medium flowing in the indoor units 3 between the heat exchanger related to heat tranfers medium 25*a* and the heat tranfers medium flow switching device 25*b*. Note that the switching stated here is referred to not only switching passages from one to the other completely, but also includes switching passages from one to the other partially.

The heat tranfers medium flow control devices 34 control the amount of heat medium flowing into the indoor units 3 by detection of temperature of the heat tranfers medium flowing into and flowing out of the indoor units 3, and thus is capable of supplying the optimum amount of heat tranfers medium in relation to the indoor load. Note that in FIG. 2, although each of the heat tranfers medium flow control devices 34 are disposed between corresponding use side heat exchangers 35 and heat tranfers medium flow switching devices 32, each of the heat tranfers medium flow control devices 34 may be disposed between corresponding use side heat exchangers 35 and the heat tranfers medium flow switching devices 33. Further, in the indoor units 3, during suspension, thermo-off, or the like, when no load is demanded from the air-conditioning apparatus, the heat tranfers medium flow control devices 34 may be totally closed and the supply of the heat tranfers medium to the indoor units 3 may be stopped.

Furthermore, in the sub relay units 2*b*, heat tranfers medium conveying devices 31 (31*a* and 31*b*) corresponding to each of the heat exchangers related to heat tranfers medium25*a* and 25*b* are provided to convey the heat tranfers medium, such as water or brine, to each of the indoor units 3. Each of the heat tranfers medium conveying devices 31 is, for example, a pump and is disposed in the heat tranfers medium piping 5 between each of the heat exchangers related to heat tranfers medium 25*a* and 25*b* and the heat tranfers medium flow switching devices 33. The heat tranfers medium conveying devices 31 are capable of controlling the flow rate of the heat tranfers medium based on the amount of load demanded by the indoor units 3.

As described above, by adopting the above configuration of the Embodiment, an optimum cooling operation or heating operation can be achieved in accordance with each indoor load.

FIGS. 2, 3, 4, and 5 are system configurations of the above, illustrating the flows of the refrigerant and the heat tranfers medium according to each operation mode when a single sub relay unit 2*b* is provided to a single main relay unit 2*a* and when four indoor units 3 are provided to the sub relay unit 2*b*. Note that one or more sub relay units 2*b* may be connected to the main relay unit 2*a*. Further, the number of indoor units 3 connected to the sub relay unit 2*b* is not limited to four.

The flows of the refrigerant and the heat tranfers medium according to each operation mode will be described hereinafter. As regards the operation modes of the above air-conditioning apparatus, there is a heating only operation mode in which all of the driving indoor units 3 perform heating operation, and a cooling only operation mode in which all of the driving indoor units 3 perform cooling operation. In addition to these modes, there is a cooling main operation mode in which the load of the indoor units that are performing cooling operation is larger in a mixed operation mode in which cooling operation and heating operation is mixed on the indoor units 3 side, and there is a heating main operation mode in which the load of the indoor units that are performing heating operation is larger in the mixed operation mode in which cooling operation and heating operation is mixed on the indoor units 3 side. Here, the flows of the refrigerant and the heat tranfers medium will be each described such that in FIG. 2, the heating only operation mode, in FIG. 3, the cooling only operation mode, in FIG. 4, the cooling main operation mode, and in FIG. 5, the heating main operation mode will be described.

FIG. 2 illustrates the flows of the refrigerant during the heating only operation mode of the air-conditioning apparatus. In the refrigerant circuit in FIG. 2, the circuit with thick lines shows the refrigerant flow during the heating only operation mode. In addition, the flow direction of the heat source side refrigerant is depicted with solid line arrows, and the flow direction of the heat tranfers medium is depicted with broken line arrows.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 and the check valve 13*a*, flows through the refrigerant piping 4, and flows into the main relay unit 2*a*. Note that the first refrigerant flow switching device 11 is switched such that the high-temperature high-pressure gas refrigerant discharged from the compressor 10 does not pass through the heat source side heat exchanger 12 in the outdoor unit 1 and is sent out from the outdoor unit 1. The gas refrigerant that has flowed into the main relay unit 2*a* passes through a gas side in the gas-liquid separator 21 and is sent out to the sub relay unit 2*b*, is branched and flows into the second refrigerant flow switching devices 28*a* and 28*b* in the sub relay unit 2*b*-1. Here, the first expansion device 22 is closed, the opening degree of the second expansion device 23 is controlled such that the pressure is constant in the second pressure detection device 45*b*, and the second refrigerant flow switching devices 28*a* and 28*b* are switched to the heating side. Each gas refrigerant that has passed through the second refrigerant flow switching devices 28*a* and 28*b* flows though the heat exchangers related to heat tranfers medium 25*a* and 25*b* and exchanges heat with the heat tranfers medium, such as water or brine, therein. Each refrigerant that has exchanged heat with the heat tranfers medium and has turned into a high-temperature high-pressure liquid refrigerant, passes through the third expansion devices 26*a* and 26*b*, is expanded, and is turned into a medium pressure liquid refrigerant. Each medium pressure liquid refrigerant that has passed through the third expansion devices 26*a* and 26*b* merges and flows into the main relay unit 2*a*. Note that at this time, the fourth expansion device 29 is totally closed and does not perform its expansion function. Further, when an on-off device is used as the fourth expansion device 29, the on-off device is closed during the heating only operation mode. The middle pressure liquid refrigerant that has flowed into the main relay unit 2*a* passes through the second expansion device 23 and turns into a low-temperature low-pressure, two-phase refrigerant having gas and liquid mixed therein, and passes through the refrigerant piping 4 and is conveyed to the outdoor unit 1. The low-temperature low-pressure refrigerant that has been conveyed to the outdoor unit 1 passes through the check valve 13*b* and flows into the heat source side heat exchanger 12, turns into a low-temperature low-pressure gas refrigerant by exchanging heat with the outdoor space 6, passes through the first refrigerant flow switching device 11, flows into the accumulator 19, and is returned to the compressor 10.

Next, the flow of the heat tranfers medium in the heating only operation mode in FIG. 2 will be described. As described above, the heat tranfers medium, such as water or brine, exchanges heat with the high-temperature high-pressure refrigerant in the heat exchangers related to heat tranfers medium 25*a* and 25*b*, and turns into a high-temperature heat tranfers medium. Each of the heat tranfers medium that has been turned into a high temperature heat tranfers medium in the heat exchangers related to heat tranfers medium 25*a* and 25*b* is conveyed to the indoor units 3 by each of the heat tranfers medium conveying devices 31*a* and 31*b* that is connected to the heat exchangers related to heat tranfers medium 25*a* and 25*b*. Each heat tranfers medium that has been conveyed passes through the heat tranfers medium flow switching device (inlet side) 33 that is connected to each indoor units 3, and the flow rate of the heat tranfers medium flowing into each of the indoor units 3 is controlled in each of the heat tranfers medium flow control devices 34. Note that at this time, in order to supply the heat tranfers medium conveyed from both of the heat exchangers related to heat tranfers medium 25*a* and 25*b* to the heat tranfers medium flow control devices 34 and the indoor units 3, each of the heat tranfers medium flow switching devices 33 is controlled such that the opening degree is at an intermediate degree or the opening degree is in accordance with the temperature of the heat tranfers medium at the outlet of the heat exchangers related to heat tranfers medium 25*a* and 25*b*. The heat tranfers medium that has flowed into each of the indoor units 3, which is connected to the heat tranfers medium pipings 5, performs heating operation by exchanging heat in the use side heat exchanger 35 with the indoor air of the indoor space 7. The heat tranfers medium that has exchanged heat in the use side heat exchangers 35 passes through the heat tranfers medium pipings 5 and the heat tranfers medium flow control devices 34, and is conveyed into the sub relay unit 2*b*. The conveyed heat tranfers medium is made to flow to each of the heat exchangers related to heat tranfers medium 25*a* and 25*b* through the heat tranfers medium flow switching devices (outlet side) 32, receives the quantity of heat, which has been supplied to the indoor space 7 through the indoor units 3, from the refrigerant side, and is conveyed to the heat tranfers medium conveying devices 32*a* and 31*b* again.

Figure 3:
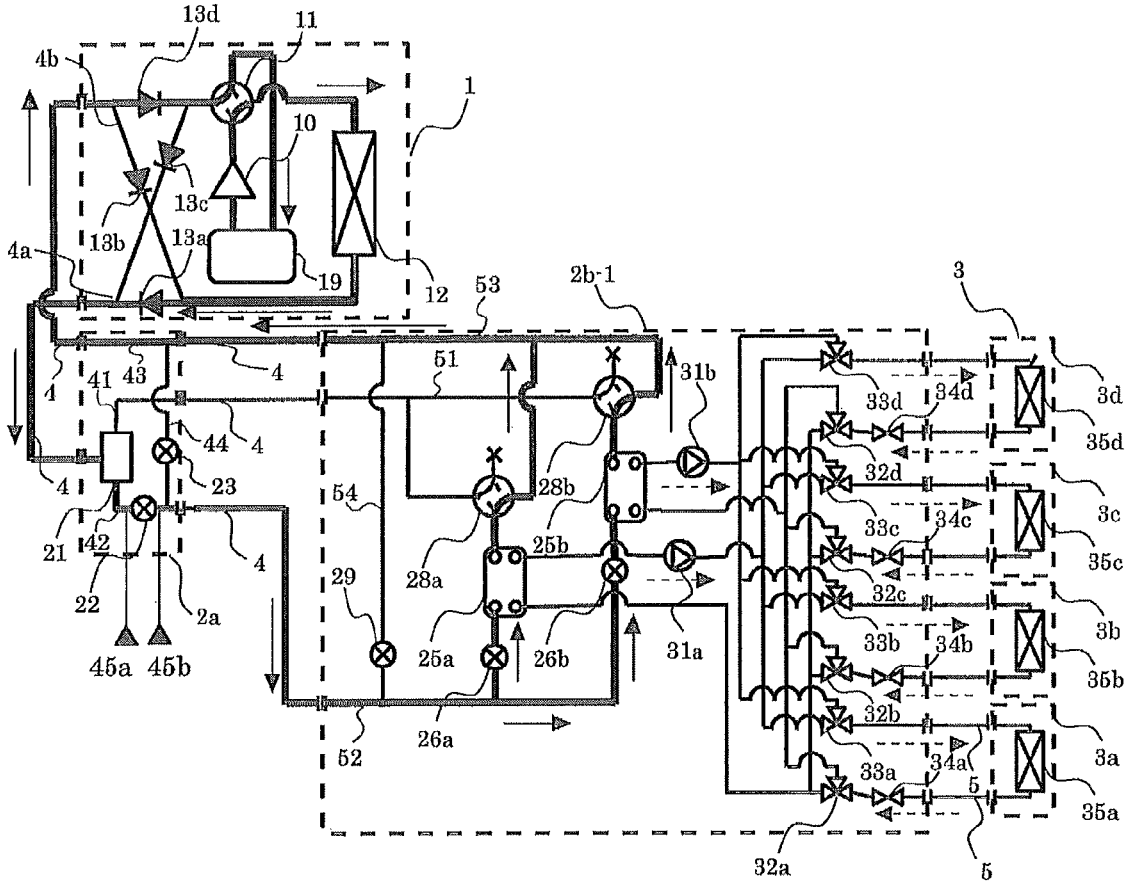
FIG. 3 is a system circuit diagram, which is among the system circuit diagrams of the air-conditioning apparatus according to Embodiment of the invention, during a cooling only operation.

FIG. 3 illustrates the flows of the refrigerant during the cooling only operation mode of the air-conditioning apparatus above mentioned. In the refrigerant circuit in FIG. 3, the circuit with thick lines shows the refrigerant flow during the cooling only operation mode. In addition, the flow direction of the heat source side refrigerant is depicted with solid line arrows, and the flow direction of the heat tranfers medium is depicted with broken line arrows.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 in the outdoor unit 1, is made to exchange heat by the heat source side heat exchanger 12 in the outdoor unit, and is turned into a high-temperature high-pressure liquid refrigerant. Note that the first refrigerant flow switching device 11 is switched such that the high-temperature high-pressure gas refrigerant discharged from the compressor 10 passes through the heat source side heat exchanger 12 in the outdoor unit 1. The high-temperature high-pressure liquid refrigerant passes through the check valve 13*a*, flows through the refrigerant piping 4, and flows into the main relay unit 2*a*. The high-temperature high-pressure liquid refrigerant that has flowed into the main relay unit 2*a* passes through a liquid side in the gas-liquid separator 21 and is sent out to the sub relay unit 2*b*. At this time, the opening degree of the first expansion device 22 is controlled so that the pressure of the second pressure detection device 45*b* is constant. The first expansion device 22 turns the high-temperature high-pressure liquid refrigerant into a middle pressure liquid refrigerant and sends out to the refrigerant to the sub relay unit 2*b*. The refrigerant is expanded by passing through the third expansion devices 26*a* and 26*b*, which are disposed on the upstream side of the heat exchangers related to heat tranfers medium 25*a* and 25*b* in the sub relay unit 2*b*, and is turned into a low-temperature low-pressure two-phase gas-liquid refrigerant. Here, the second expansion devices 23 are totally closed and the second refrigerant flow switching devices 28*a* and 28*b* are switched to the cooling side. The low-temperature low-pressure two-phase refrigerant exchanges heat with the heat tranfers medium, such as water or brine, in the heat exchangers related to heat tranfers medium 25*a* and 25*b* by passing therethrough, and turns into a low-temperature low-pressure gas refrigerant. The low-temperature low-pressure gas refrigerant passes through each of the second refrigerant flow switching devices 28*a* and 28*b*, flows through the main relay unit 2*a*, and is conveyed to the outdoor unit 1 through the refrigerant piping 4. Note that the fourth expansion device 29 is totally closed. Further, the fourth expansion device 29 may be an on-off device, and during the cooling only operation mode, the on-off device is closed. The low-temperature low-pressure refrigerant that has been conveyed to the outdoor unit 1 passes through the check valve 13*d*, is guided into the accumulator 19 by the first refrigerant flow switching device 11, and is returned to the compressor 1.

Next, the flow of the heat tranfers medium in the cooling only operation mode in FIG. 3 will be described. As described above, each of the heat tranfers medium, such as water or brine, is turned into a low temperature heat tranfers medium in the heat exchangers related to heat tranfers medium 25*a* and 25*b*, and is conveyed to the indoor units 3 side by each of the heat tranfers medium conveying devices 31*a* and 31*b* that is connected to the heat exchangers related to heat tranfers medium 25*a* and 25*b*. Each heat tranfers medium that has been conveyed passes through the heat tranfers medium flow switching device (inlet side) 33 that is connected to each indoor units 3, and the flow rate of the heat tranfers medium flowing into each of the indoor units 3 is controlled in each of the heat tranfers medium flow control devices 34. Note that at this time, in order to supply the heat tranfers medium conveyed from both of the heat exchangers related to heat tranfers medium 25*a* and 25*b* to the heat tranfers medium flow control devices 34 and the indoor units 3, each of the heat tranfers medium flow switching devices 33 is controlled such that the opening degree is at an intermediate degree or the opening degree is in accordance with the temperature of the heat tranfers medium at the outlet of the heat exchangers related to heat tranfers medium 25*a* and 25*b*. The heat tranfers medium that has flowed into each of the indoor units 3, which is connected to the heat tranfers medium pipings 5, performs cooling operation by exchanging heat in the use side heat exchanger 35 with the indoor air of the indoor space 7. The heat tranfers medium that has exchanged heat in the use side heat exchangers 35 passes through the heat tranfers medium pipings 5 and the heat tranfers medium flow control devices 34, and is conveyed into the sub relay unit 2*b*. The conveyed heat tranfers medium flows into each of the heat exchangers related to heat tranfers medium 25*a* and 25*b* through the heat tranfers medium flow switching devices (outlet side) 32, transfers the quantity of heat, which has been transferred to the heat tranfers medium from the indoor space 7 through the indoor units 3, to the refrigerant side, thus turning low in temperature, and is conveyed to the heat tranfers medium conveying device 31*a* and 31*b* again.

Figure 4:
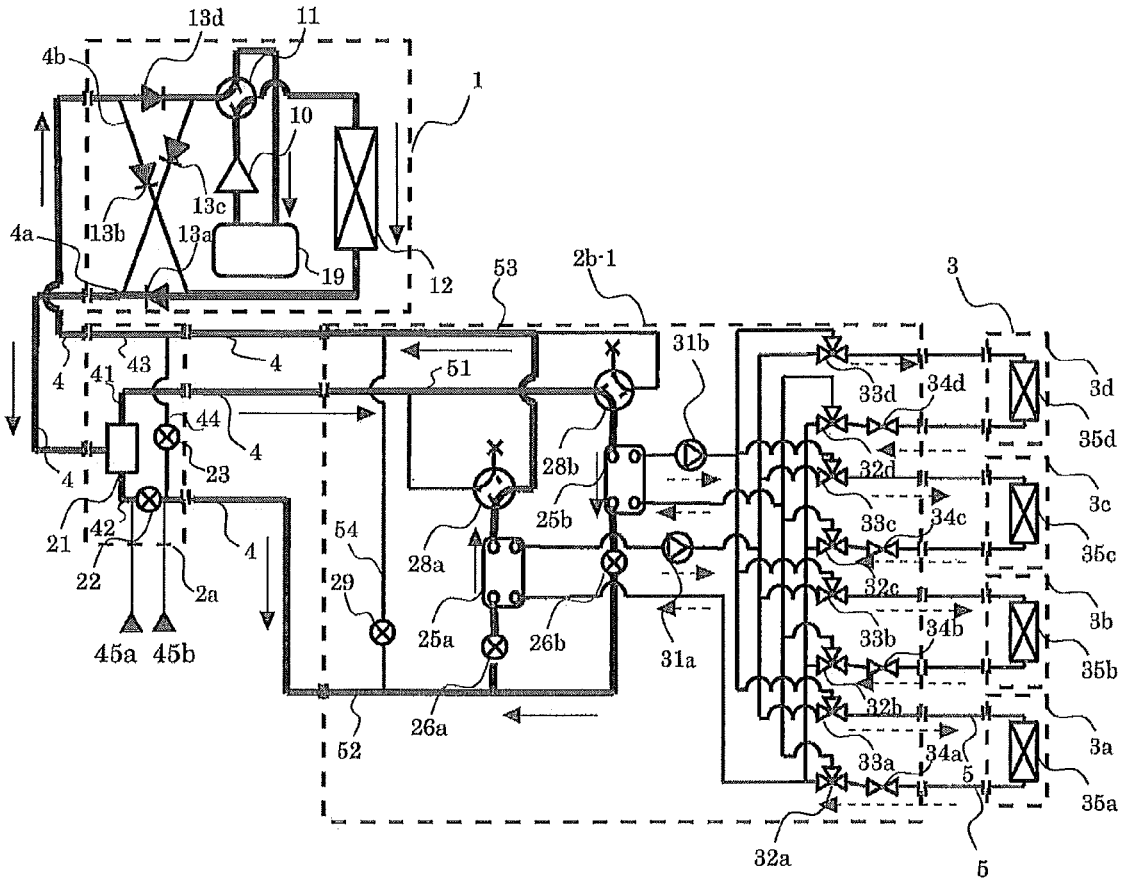
FIG. 4 is a system circuit diagram, which is among the system circuit diagrams of the air-conditioning apparatus according to Embodiment of the invention, during a cooling main operation.

FIG. 4 illustrates the flows of the refrigerant during the cooling main operation mode of the air-conditioning apparatus above mentioned. In the refrigerant circuit in FIG. 4, the circuit with thick lines shows the refrigerant flow during the cooling main operation mode. In addition, the flow direction of the heat source side refrigerant is depicted with solid line arrows, and the flow direction of the heat tranfers medium is depicted with broken line arrows.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 in the outdoor unit 1, exchanges the heat capacity in the refrigerant, transferred at the heat source side heat exchanger 12, except for the amount required by the indoor units 3, out of all the indoor units, undergoing the heating operation mode, and turns into a high-temperature high-pressure gas or two-phase gas-liquid refrigerant. Note that the first refrigerant flow switching device 11 is switched such that the high-temperature high-pressure gas refrigerant discharged from the compressor 10 passes through the heat source side heat exchanger 12 in the outdoor unit 1. The high-temperature high-pressure gas or two-phase refrigerant passes through the check valve 13*a*, flows through the refrigerant piping 4, and flows into the main relay unit 2*a*. The high-temperature high-pressure gas or two-phase refrigerant that has flowed into the main relay unit 2*a* is separated into gas refrigerant and liquid refrigerant in the gas-liquid separator 21 and is sent out to the sub relay unit 2*b*. Based on the pressure difference between the first pressure detection device 45*a*, which is the inlet pressure of the first expansion device 22 itself, and the second pressure detection device 45*b*, which it the outlet pressure, the opening degree of the first expansion device 22 is controlled so that the pressure difference can be maintained to be constant. Note that the second expansion device 23 is totally closed. Among the second refrigerant flow switching device 28*a* and the second refrigerant flow switching device 28*b* in the sub relay unit 2*b*, the second refrigerant flow switching device 28*a* is switched to the cooling side, and the second refrigerant flow switching device 28*b* to the heating side. The gas refrigerant, which has flowed through the second refrigerant flow switching device 28*b* and into the sub relay unit 2*b*, flows into the heat exchanger related to heat tranfers medium 25*b*. The high-temperature high-pressure gas or two-phase refrigerant that has flowed into the heat exchanger related to heat tranfers medium 25*b* provides quantity of heat to the heat tranfers medium, such as water or brine, that has also flowed into the heat exchanger related to heat tranfers medium 25*b*, and turns into a high-temperature high-pressure liquid refrigerant. The refrigerant that has turned into a high-temperature high-pressure liquid is expanded by passing through the third expansion device 26*b*, and turns into a medium pressure liquid refrigerant. In addition, here, the third expansion device 26*b* is controlled so that the degree of subcooling of the refrigerant in the outlet of the heat exchanger related to heat tranfers medium 25*b* becomes a target value. The refrigerant that has turned into a middle pressure two-phase refrigerant passes through the third expansion device 26*a*, turns into a low-temperature low-pressure refrigerant, and flows into the heat exchanger related to heat tranfers medium 25*a*. The refrigerant exchanges heat with the heat tranfers medium in the heat exchanger related to heat tranfers medium 25*a* by receiving quantity of heat from the heat tranfers medium, such as water or brine, that has also flowed into the heat exchanger related to heat tranfers medium 25*a*, and turns into a low-temperature low-pressure gas refrigerant. In addition, here, the third expansion device 26*a*, which the refrigerant passes through, is controlled so that the degree of superheat of the refrigerant that has passed through the heat exchanger related to heat tranfers medium 25*a* and has exchanged heat becomes a target value. Further, the fourth expansion device 29 is totally closed. The low-temperature low-pressure gas refrigerant passes through the second refrigerant flow switching device 28*a*, flows through the main relay unit 2*a*, and is conveyed to the outdoor unit 1 through the refrigerant piping 4. The low-temperature low-pressure refrigerant that has been conveyed to the outdoor unit 1 passes through the check valve 13*d*, is guided into the accumulator 19 by the first refrigerant flow switching device 11, and is returned to the compressor 1.

Next, the flow of the heat tranfers medium in the cooling main operation mode in FIG. 4 will be described. As aforedescribed, the heat tranfers medium that has been tuned into a heat tranfers medium of low temperature by the heat exchanger related to heat tranfers medium 25*a* is conveyed by the heat tranfers medium conveying device 31*a* connected to the heat exchanger related to heat tranfers medium 25*a*, and the heat tranfers medium that has been turned into a heat tranfers medium of high temperature by the heat exchanger related to heat tranfers medium 25*b* is conveyed by the heat tranfers medium conveying device 31*b* connected to the heat exchanger related to heat tranfers medium 25*b*. Each heat tranfers medium that has been conveyed passes through the heat tranfers medium flow switching device (inlet side) 33 that is connected to each indoor units 3, and the flow rate of the heat tranfers medium flowing into each of the indoor units 3 is controlled in each of the heat tranfers medium flow control devices 34. Note that when the indoor unit 3 that is connected to the heat tranfers medium flow switching device 33 is in the heating operation mode, the heat tranfers medium flow switching device 33 switches to the direction in which the heat exchanger related to heat tranfers medium 25*b* and the heat tranfers medium conveying device 31*b* are connected to, and when the indoor unit 3 that is connected to the heat tranfers medium flow switching device 33 is in the cooling operation mode, the heat tranfers medium flow switching device 33 switches to the direction in which the heat exchanger related to heat tranfers medium 25*a* and the heat tranfers medium conveying device 31*a* are connected to. That is, depending on the operation mode of the indoor units 3, the heat tranfers medium that is supplied to the indoor units 3 can be switched to hot water or cold water. The heat tranfers medium that has flowed into each of the indoor units 3, which is connected to the heat tranfers medium pipings 5, performs heating operation or cooling operation by exchanging heat in the use side heat exchanger 35 with the indoor air of the indoor space 7. The heat tranfers medium that has exchanged heat in the use side heat exchangers 35 passes through the heat tranfers medium pipings 5 and the heat tranfers medium flow control devices 34, and is conveyed into the sub relay unit 2*b*. The heat tranfers medium that has been conveyed flows into the heat tranfers medium flow switching devices (outlet side) 32. When the indoor unit 3 that is connected to the heat tranfers medium flow switching device 32 is in the heating operation mode, the heat tranfers medium flow switching device 33 switches to the direction in which the heat exchanger related to heat tranfers medium 25*b* is connected to, and when the indoor unit 3 that is connected to the heat tranfers medium flow switching device 33 is in the cooling operation mode, the heat tranfers medium flow switching device 33 switches to the direction in which the heat exchanger related to heat tranfers medium 25*a* is connected to. Accordingly, the heat tranfers medium that has been used in the heating operation mode is appropriately conveyed to the heat exchanger related to heat tranfers medium 25*b* where the refrigerant is transferring heat for heating, and the heat tranfers medium that has been used in the cooling operation mode is appropriately conveyed to the heat exchanger related to heat tranfers medium 25*a* where the refrigerant is receiving heat for cooling, and after each heat tranfers medium have exchanged heat with the refrigerant once more, the heat tranfers medium is sent to the heat tranfers medium conveying devices 31*a* and 31*b*.

Figure 5:
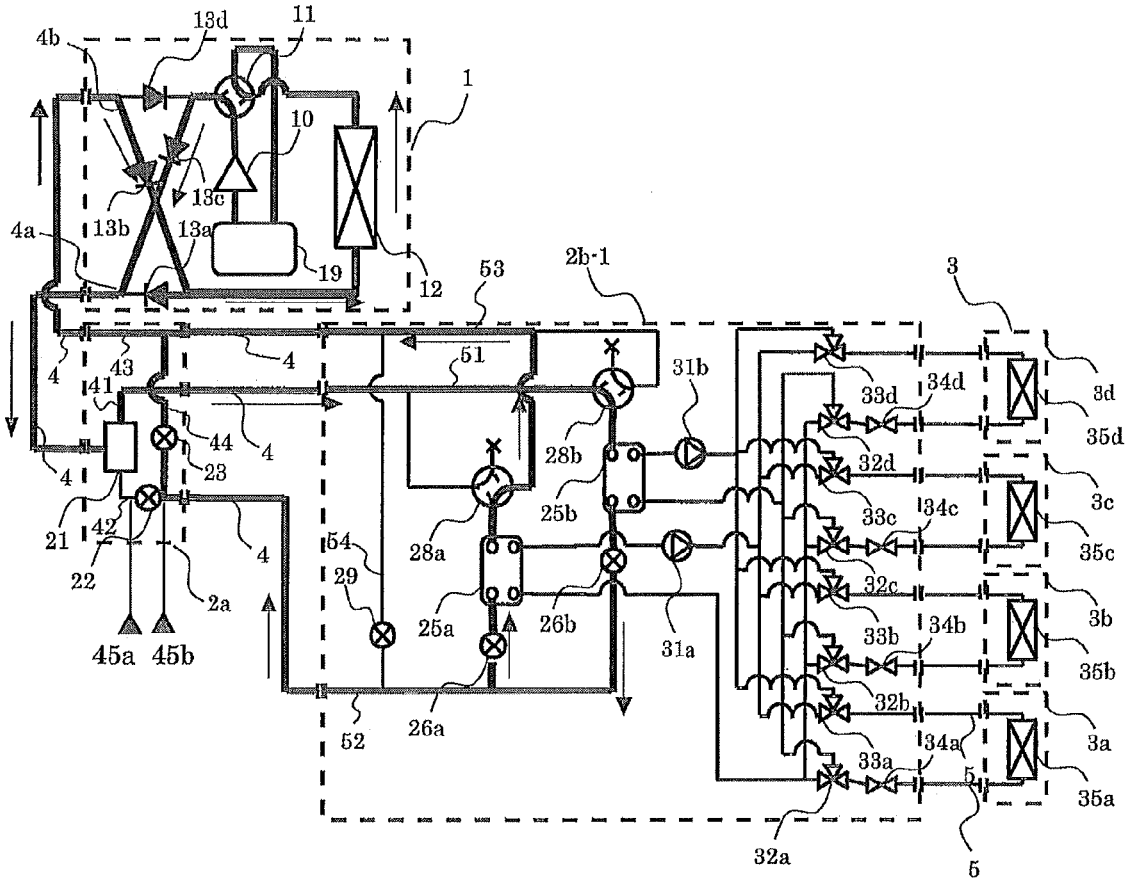
FIG. 5 is a system circuit diagram, which is among the system circuit diagrams of the air-conditioning apparatus according to Embodiment of the invention, during a heating main operation.

FIG. 5 is a system circuit diagram illustrating the flows of the refrigerants in the heating main operation mode of the above air-conditioning apparatus. In the refrigerant circuit in FIG. 5, the circuit with thick lines shows the refrigerant flow during the heating main operation mode. In addition, the flow direction of the heat source side refrigerant is depicted with solid line arrows, and the flow direction of the heat tranfers medium is depicted with broken line arrows.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 and the check valve 13*c*, flows through the refrigerant piping 4, and flows into the main relay unit 2*a*. Note that the first refrigerant flow switching device 11 is switched such that the high-temperature high-pressure gas refrigerant discharged from the compressor 10 does not pass through the heat source side heat exchanger 12 in the outdoor unit 1 and is sent out from the outdoor unit 1. The high-temperature high-pressure gas refrigerant that has flowed into the main relay unit 2*a* passes through the gas side in the gas-liquid separator 21 and is sent out to the sub relay unit 2*b*, passes through the second refrigerant flow switching device 28*b* in the sub relay unit 2*b*, and flows into the heat exchanger related to heat tranfers medium 25*b*. Here, the first expansion device 22 is closed, and the opening degree of the second expansion device 23 is controlled so that the pressure of the second pressure detection device 45*b* is constant. Further, among the second refrigerant flow switching device 28*a* and the second refrigerant flow switching device 28*b* in the sub relay unit 2*b*-1, the second refrigerant flow switching device 28*a* is switched to the cooling side and the second refrigerant flow switching device 28*b* to the heating side. The high-temperature high-pressure gas refrigerant that has flowed into the sub relay unit 2*b*-1 and has passed through the second refrigerant flow switching device 28*b* flows into the heat exchanger related to heat tranfers medium 25*b*, transfers quantity of heat to the heat tranfers medium, such as water or brine, that is also flowing into the heat exchanger related to heat tranfers medium 25 *b*, and turns into a high-temperature high-pressure liquid. The refrigerant that has turned into a high-temperature high-pressure liquid is expanded by passing through the third expansion device 26*b*, and turns into a medium pressure liquid refrigerant. In addition, here, the third expansion device 26*b* is controlled so that the degree of subcooling of the refrigerant in the outlet of the heat exchanger related to heat tranfers medium 25*b* becomes a target value. The refrigerant that has turned into a middle pressure two-phase refrigerant passes through the third expansion device 26*a*, turns into a low-temperature low-pressure refrigerant, and flows into the heat exchanger related to heat tranfers medium 25*a*. The refrigerant receives quantity of heat from the heat tranfers medium, such as water or brine, that is also flowing into the heat exchanger related to heat tranfers medium 25*a*. In addition, here, the third expansion device 26*a*, which the refrigerant passes through, is controlled so that the degree of superheat of the refrigerant that has passed through the heat exchanger related to heat tranfers medium 25*a* and has exchanged heat becomes a target value. Further, the refrigerant that has passed through the second refrigerant flow switching device 28*a*, flows through the main relay unit 2*a*, and is conveyed to the outdoor unit 1 through the refrigerant piping 4. Furthermore, here, the fourth expansion device 29 is totally closed. The low-temperature low-pressure two-phase refrigerant that has been conveyed to the outdoor unit 1 passes through the check valve 13*b*, exchanges heat with the outdoor space 6 by passing through the heat source side heat exchanger 12, turns into a low-temperature low-pressure gas refrigerant, flows into the accumulator 19 through the first refrigerant flow switching device 11, and is returned to the compressor 10.

Next, the flow of the heat tranfers medium in the heating main mode in FIG. 5 will be described. As described previously, each of the heat tranfers medium, such as water or brine, that has been tuned into a heat tranfers medium of low temperature by the heat exchanger related to heat tranfers medium 25*a* is conveyed by the heat tranfers medium conveying device 31*a* connected to the heat exchanger related to heat tranfers medium 25*a*, and the heat tranfers medium that has been turned into a heat tranfers medium of high temperature by the heat exchanger related to heat tranfers medium 25*b* is conveyed by the heat tranfers medium conveying device 31*b* connected to the heat exchanger related to heat tranfers medium 25*b*. Each heat tranfers medium that has been conveyed passes through the heat tranfers medium flow switching device (inlet side) 33 that is connected to each indoor units 3, and the flow rate of the heat tranfers medium flowing into each of the indoor units 3 is controlled in each of the heat tranfers medium flow control devices 34. When the indoor unit 3 that is connected to the heat tranfers medium flow switching device 33 is in the heating operation mode, the heat tranfers medium flow switching device 33 switches to the direction in which the heat exchanger related to heat tranfers medium 25*b* and the heat tranfers medium conveying device 31*b* are connected to, and when the indoor unit 3 that is connected to the heat tranfers medium flow switching device 33 is in the cooling operation mode, the heat tranfers medium flow switching device 33 switches to the direction in which the heat exchanger related to heat tranfers medium 25*a* and the heat tranfers medium conveying device 31*a* are connected to. That is, depending on the operation mode of the indoor units 3, the heat tranfers medium that is supplied to the indoor units 3 can be switched to hot water or cold water. The heat tranfers medium that has flowed into each of the indoor units, which is connected to the heat tranfers medium pipings 5, performs heating operation or cooling operation by exchanging heat in the use side heat exchanger 35 with the indoor air of the indoor space 7. The heat tranfers medium that has exchanged heat in the use side heat exchangers 35 passes through the heat tranfers medium pipings 5 and the heat tranfers medium flow control devices 34, and is conveyed into the sub relay unit 2*b*. The heat tranfers medium that has been conveyed flows into the heat tranfers medium flow switching devices (outlet side) 32. When the indoor unit 3 that is connected to the heat tranfers medium flow switching device 32 is in the heating operation mode, the heat tranfers medium flow switching device 33 switches to the direction in which the heat exchanger related to heat tranfers medium 25*b* is connected to, and when the indoor unit 3 that is connected to the heat tranfers medium flow switching device 33 is in the cooling operation mode, the heat tranfers medium flow switching device 33 switches to the direction in which the heat exchanger related to heat tranfers medium 25*a* is connected to. Accordingly, the heat tranfers medium that has been used in the heating operation mode is conveyed to the heat exchanger related to heat tranfers medium 25*b* where the refrigerant is transferring heat for heating, and the heat tranfers medium that has been used in the cooling operation mode is conveyed to the heat exchanger related to heat tranfers medium 25*a* where the refrigerant is receiving heat for cooling, and after each heat tranfers medium have exchanged heat with the refrigerant once more, the heat tranfers medium is sent to the heat tranfers medium conveying devices 31*a* and 31*b*.

FIGS. 6, 7, 8, and 9 are configuration diagrams of refrigerant circuits according to another Embodiment of the invention. In FIGS. 6 to 9, the flows of a refrigerant and a heat tranfers medium according to each operation mode when a plurality of sub relay units 2*b* is provided to a single main relay unit 2*a* and when four indoor units 3 are provided to each of the sub relay units 2*b*. In the operation mode of this air-conditioning apparatus, there is a heating only operation mode in which all of the driving indoor units 3 are undergoing heating operation, and a cooling only operation mode in which all of the driving indoor units 3 are undergoing cooling operation, in which the indoor units 3 are connected to the sub relay units 2*b* that is all connected to the main relay unit 2*a*. In addition to these modes, there is a cooling main operation mode in which the ratio of the load of the cooling operation mode is greater in the total operation load in which all of the indoor units 3 that is connected to the sub relay units 2*b* are undergoing a mixed operation of the cooling operation and heating operation, and there is a heating main operation mode in which the ratio of the load of the heating operation mode is greater in the total operation load in which the indoor units 3 are undergoing a mixed operation of the cooling operation and heating operation. Hereinafter, the flows of the refrigerant and the heat tranfers medium will be described such that in FIG. 6, the heating only operation mode, in FIG. 7, the cooling only operation mode, in FIG. 8, the cooling main operation mode, and in FIG. 9, the heating main operation mode will be described.

Note that in FIGS. 6 to 8, although system diagrams with four sub relay units 2*b* connected to the main relay unit 2*a* are shown, two out of the four are schematically illustrated, and in the system operation described hereinafter, a system operation with two sub relay units 2*b* is described. However, even with more than four sub relay units 2*b*, the operation of the sub relay units 2*b* is the same. Further, the number of sub relay units 2*b* to the main relay unit 2*a* is not limited to four, and the number of indoor units to the sub relay units 2*b* is not limited to four. Note that in the operation of the system described hereinafter, the flows of the heat tranfers medium are the same as each operation mode in FIGS. 2 to 5. Accordingly, description thereof will be omitted.

Figure 6:
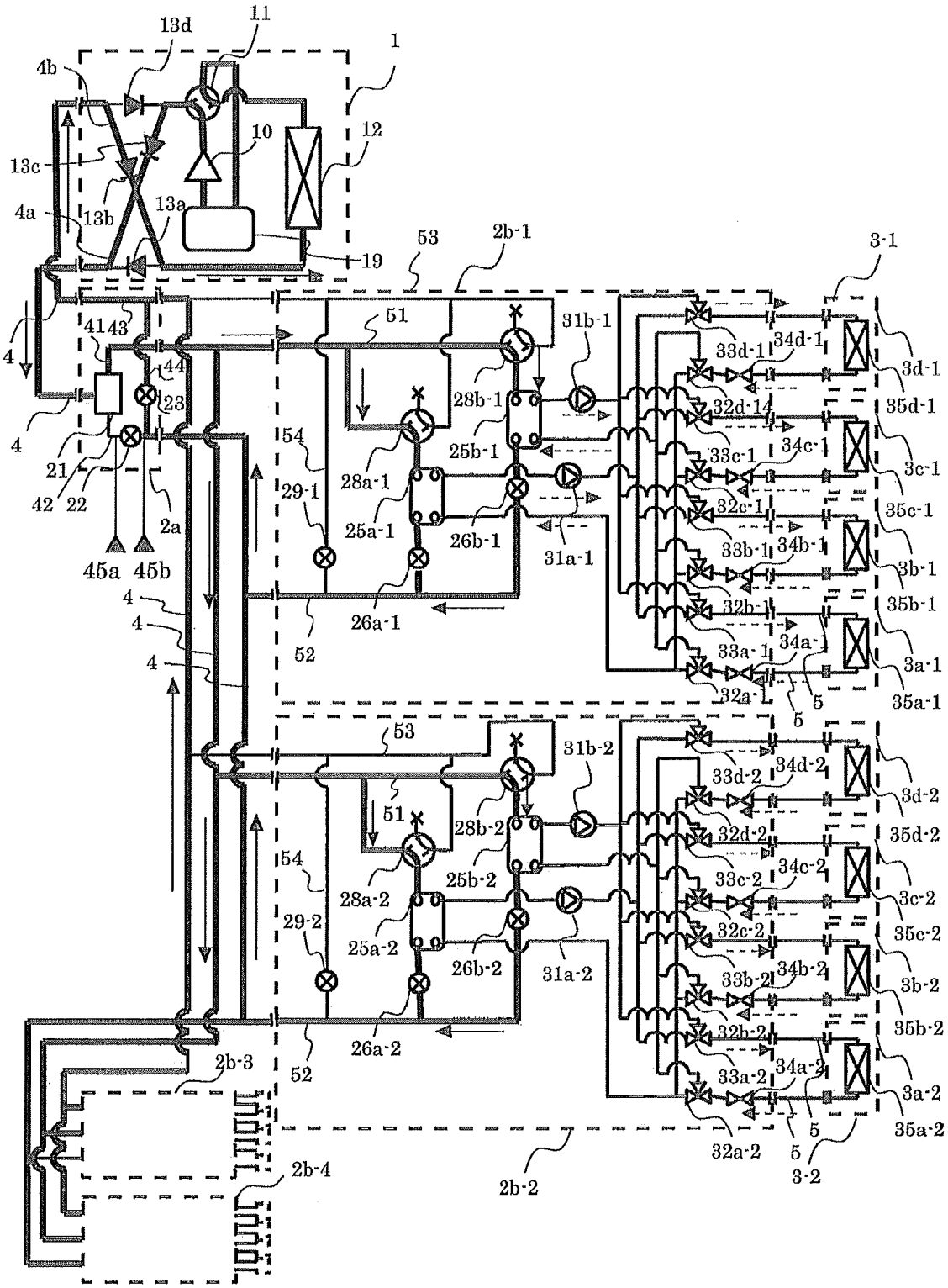
FIG. 6 Among air-conditioning apparatuses according to Embodiment of the invention.

FIG. 6 is a system circuit diagram (refrigerant circuit diagram) illustrating the flows of the refrigerants in the heating only operation mode. In the refrigerant circuit in FIG. 6, the circuit with thick lines shows the refrigerant flow during the heating only operation mode. In addition, the flow direction of the refrigerant is depicted with solid line arrows, and the flow direction of the heat tranfers medium is depicted with broken line arrows.

A low-temperature low-pressure refrigerant flows into a compressor 10 and is discharged as a high-temperature high-pressure gas refrigerant. The discharged high-temperature high-pressure refrigerant passes through a first refrigerant flow switching device 11 and a check valve 13*c*, flows through a refrigerant piping 4, and flows into a main relay unit 2*a*. Note that the first refrigerant flow switching device 11 is switched such that the high-temperature high-pressure gas refrigerant discharged from the compressor 10 does not pass through a heat source side heat exchanger 12 in an outdoor unit 1 and is sent out from the outdoor unit 1. The gas refrigerant that has flowed into the main relay unit 2*a* passes through a gas side in a gas-liquid separator 21, is sent out from the main relay unit 2*a*, is branched, and is conveyed to each sub relay units 2*b*-1, 2*b*-2, 2*b*-3, and 2*b*-4. Here, a first expansion device 22 is closed, and the opening degree of a second expansion device 23 is controlled so that the pressure of a second pressure detection device 45*b* is constant. The high-temperature high-pressure gas refrigerant sent out from the main relay unit 2*a* is branched and flows into each sub relay units 2*b*-1, 2*b*-2, 2*b*-3, and 2*b*-4. Note that in the heating only operation mode, the second refrigerant flow switching devices 28*a* and 28*b* are each switched to the heating side. The refrigerant that has passed through the second refrigerant flow switching devices 28*a* and 28*b* in each sub relay units, further flows though heat exchangers related to heat tranfers medium 25*a* and 25*b* and exchanges heat with the heat tranfers medium, such as water or brine, therein. The refrigerant that has exchanged heat with the heat tranfers medium turns into a high-temperature high-pressure liquid refrigerant. The refrigerant that has turned into a high-temperature high-pressure liquid refrigerant is each expanded by passing through third expansion devices 26*a* and 26*b*, and turns into a medium pressure liquid refrigerant. Each refrigerant that has been turned into a medium pressure liquid refrigerant in the third expansion devices 26*a* and 26*b* are merged, passes through a sub-unit second refrigerant passage 52, sent out from each sub relay units 2*b*-1, 2*b*-2, 2*b*-3, and 2*b*-4, merges, and flows into the main relay unit 2*a*. Note that at this time, a fourth expansion device 29 is totally closed and does not perform its expansion function. The medium pressure liquid refrigerant that has flowed out of each sub relay units 2*b*-1, 2*b*-2, 2*b*-3, and 2*b*-4, that has merged, and that has flowed into the main relay unit 2*a*, passes through the second expansion device 23 in which the opening degree is controlled such that the pressure of the second pressure detection device 45*b* is constant, turns into a low-temperature low-pressure two-phase refrigerant having gas and liquid mixed therein, passes through the refrigerant piping 4, and is conveyed to the outdoor unit 1. The low-temperature low-pressure two-phase refrigerant that has been conveyed to the outdoor unit 1 passes through a check valve 13*b* and flows into the heat source side heat exchanger 12, turns into a low-temperature low-pressure gas refrigerant by exchanging heat with an outdoor space 6, passes through the first refrigerant flow switching device 11, flows into an accumulator 19, and is returned to the compressor 10.

Figure 7:
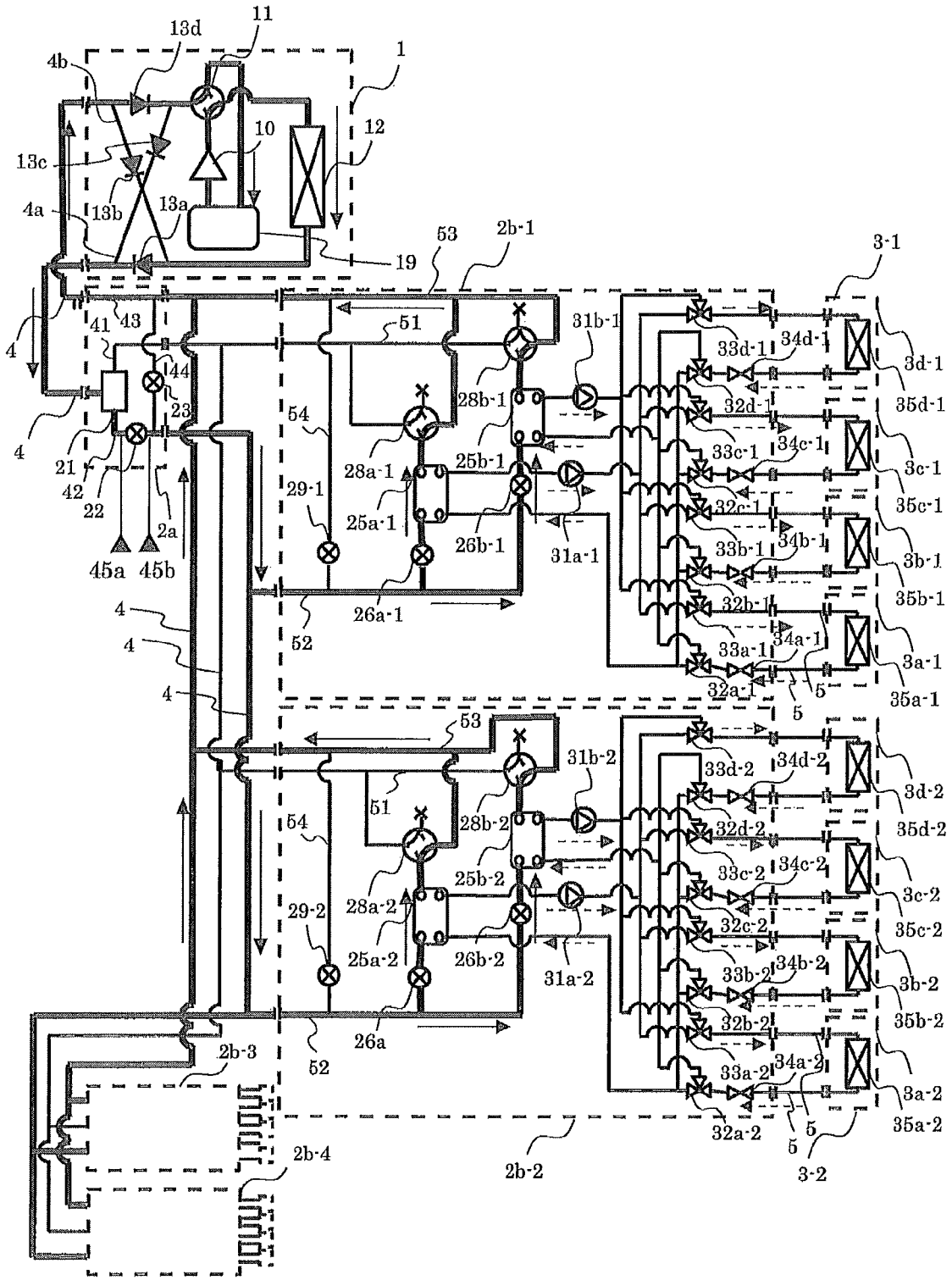
FIG. 7 Among the air-conditioning apparatuses according to Embodiment of the invention.

FIG. 7 is a system circuit diagram (refrigerant circuit diagram) illustrating the flows of the refrigerants in the cooling only operation mode of the above air-conditioning apparatus. In the refrigerant circuit in FIG. 7, the circuit with thick lines shows the refrigerant flow during the cooling only operation mode. In addition, the flow direction of the heat source side refrigerant is depicted with solid line arrows, and the flow direction of the heat tranfers medium is depicted with broken line arrows.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 in the outdoor unit 1, is made to exchange heat by the heat source side heat exchanger 12 in the outdoor unit, and is turned into a high-temperature high-pressure liquid refrigerant. The first refrigerant flow switching device 11 is switched such that the high-temperature high-pressure gas refrigerant discharged from the compressor 10 passes through the heat source side heat exchanger 12 in the outdoor unit 1. The high-temperature high-pressure liquid refrigerant passes through a check valve 13*a*, flows through the refrigerant piping 4, and flows into the main relay unit 2*a*. The high-temperature high-pressure liquid refrigerant that has flowed into the main relay unit 2*a* passes through a liquid side in the gas-liquid separator 21 and is sent out from the main relay unit 2*a*. At this time, the opening degree of the first expansion device 22 is controlled so that the pressure of the second pressure detection device 45*b* is constant. The first expansion device 22 turns the high-temperature high-pressure liquid refrigerant into a middle pressure liquid refrigerant and sends it out from the refrigerant to the main relay unit 2*a*. The middle pressure liquid refrigerant that has been sent out is branched and flows into each sub relay units 2*b*-1, 2*b*-2, 2*b*-3, and 2*b*-4. Here, the second expansion device 23 is totally closed. Further, in the cooling only operation mode, the second refrigerant flow switching devices 28*a* and 28*b* in each sub relay units are each switched to the cooling side. The middle pressure liquid refrigerant that has flowed into each sub relay units is expanded by passing through the third expansion devices 26*a* and 26*b*, which are disposed on the upstream side of the heat exchangers related to heat tranfers medium 25*a* and 25*b*, and turns into a low-temperature low-pressure two-phase gas-liquid refrigerant. The low-temperature low-pressure two-phase refrigerant exchanges heat with the heat tranfers medium, such as water or brine, in the heat exchangers related to heat tranfers medium 25*a* and 25*b* by passing therethrough, and turns into a low-temperature low-pressure gas refrigerant. The low-temperature low-pressure gas refrigerant passes through each of the second refrigerant flow switching devices 28*a* and 28*b*, is sent out from each sub relay units 2*b*-1, 2*b*-2, 2*b*-3, and 2*b*-4, is merged, flows through the main relay unit 2*a*, and is conveyed to the outdoor unit 1 through the refrigerant piping 4. Note that the fourth expansion device 29 (29-1 and 29-2 are illustrated only) is totally closed. The low-temperature low-pressure refrigerant that has been conveyed to the outdoor unit 1 passes through a check valve 13*d*, is guided into the accumulator 19 by the first refrigerant flow switching device 11, and is returned to the compressor 1.

Figure 8:
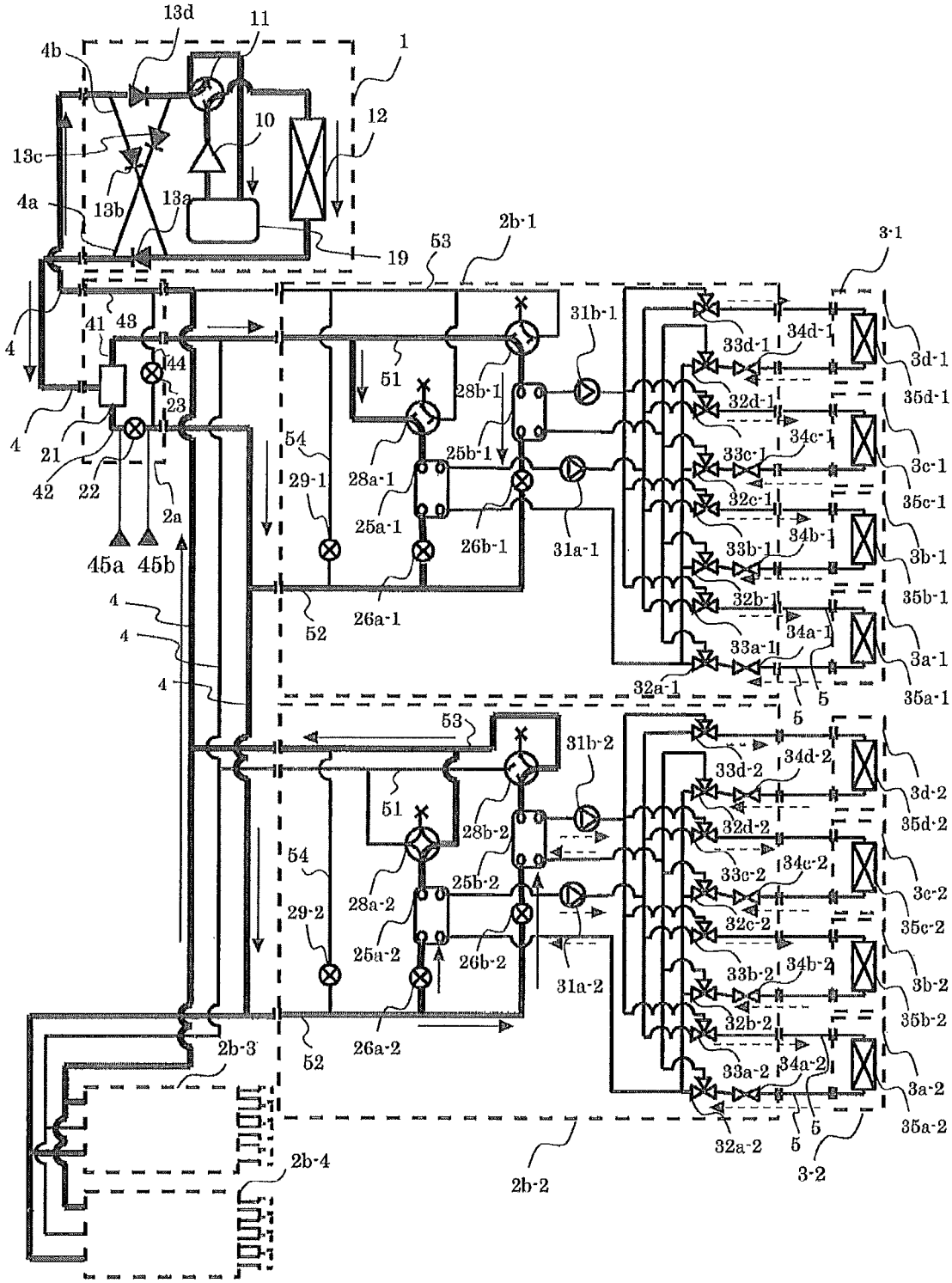
FIG. 8 Among the air-conditioning apparatuses according to Embodiment of the invention.

FIG. 8 is a system circuit diagram (refrigerant circuit diagram) illustrating the flows of the refrigerants in the cooling main operation mode of the above air-conditioning apparatus. In the refrigerant circuit in FIG. 8, the circuit with thick lines shows the refrigerant flow during the cooling main operation mode. In addition, the flow direction of the heat source side refrigerant is depicted with solid line arrows, and the flow direction of the heat tranfers medium is depicted with broken line arrows.

In FIG. 8, among the indoor units 3 that are connected to the sub relay units 2*b*-1, 2*b*-2, 2*b*-3, and 2*b*-4, the load of the indoor units 3 in the cooling operation is sufficiently greater compared to the load of the indoor units 3 in the heating operation mode, and all of the indoor units 3 that is connected to the sub relay unit 2*b*-1 is in heating operation and all of the indoor units 3 that is connected to the sub relay unit 2*b*-2 is in cooling operation.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 in the outdoor unit 1, exchanges the heat capacity in the refrigerant, transferred at the heat source side heat exchanger 12 in the outdoor unit 1, except for the amount required by the indoor units 3, out of all the indoor units, undergoing the heating operation mode, and turns into a high-temperature high-pressure gas or two-phase gas-liquid refrigerant. Note that the first refrigerant flow switching device 11 is switched such that the high-temperature high-pressure gas refrigerant discharged from the compressor 10 passes through the heat source side heat exchanger 12 in the outdoor unit 1. The high-temperature high-pressure gas or two-phase refrigerant passes through the check valve 13*a*, flows through the refrigerant piping 4, and flows into the main relay unit 2*a*. Out of the high-temperature high-pressure gas or two-phase refrigerant that has flowed into the main relay unit 2*a*, the gas refrigerant passes through the gas side and the liquid refrigerant passes through the liquid side of the gas-liquid separator 21 and is sent out from the main relay unit 2*a*. Based on the pressure difference between the first pressure detection device 45*a*, which is the inlet pressure of the first expansion device 22 itself, and the second pressure detection device 45*b*, which it the outlet pressure, the opening degree of the first expansion device 22 is controlled so that the pressure difference can be maintained to be constant. Further, the second expansion device 23 is totally closed. As regards the gas refrigerant and the liquid refrigerant that has been sent out, among the sub relay units 2*b*-1, 2*b*-2, 2*b*-3, and 2*b*-4, gas refrigerant is supplied to the sub relay units that is connected to the indoor units 3 that is undergoing heating operation, and liquid refrigerant is supplied to the sub relay units that is connected to the indoor units 3 that is undergoing cooling operation. Accordingly, as regards the sub relay unit 2*b*-1 in which the indoor units 3 are only undergoing heating operation, gas refrigerant is supplied from the main relay unit 2*a*. The refrigerant passes through each of the second refrigerant flow switching devices 28*a*-1 and 28*b*-1 in the sub relay unit 2*b*-1 and exchanges heat with the heat tranfers medium, such as water or brine, in the heat exchangers related to heat tranfers medium 25*a*-1 and 25*b*-1 by passing therethrough. Here, the second refrigerant flow switching devices 28*a*-1 and 28*b*-1 are switched to the heating side. The refrigerant that has exchanged heat with the heat tranfers medium, such as water or brine, turns into a high-temperature high-pressure liquid refrigerant, is expanded by passing through the third expansion devices 26*a*-1 and 26*b*-1, and is turned into a medium pressure liquid refrigerant. Each refrigerant that has been turned into a medium pressure liquid refrigerant in the third expansion devices 26*a*-1 and 26*b*-1 are merged, passes through a sub-unit second refrigerant passage 52, is sent out from the sub relay unit 2*b*-1, and a part flows into the main relay unit 2*a*. Here, the fourth expansion device 29-1 is totally closed. Note that the fourth expansion device 29 may be an on-off device, and during the cooling main operation mode, the on-off device is closed. Further, the remaining refrigerant is sent out to, among the other sub relay units, the sub relay units 2*b* in which the connected indoor units are undergoing heating operation, specifically, a low-temperature low-pressure two-phase refrigerant is sent out to the sub relay unit 2*b*-2 in FIG. 8.

In the sub relay unit 2*b*-2, the middle pressure liquid refrigerant that has been conveyed from the main relay unit 2*a* and the middle pressure liquid refrigerant that has been conveyed from the sub relay unit 2*b*-1 are merged, and are sent into the sub relay unit 2*b*-2. The refrigerant that has been sent in is expanded by passing through the third expansion devices 26*a*-2 and 26*b*-2, which are disposed on the upstream side of the heat exchangers related to heat tranfers medium 25*a*-2 and 25*b*-2, and is turned into a low-temperature low-pressure two-phase gas-liquid refrigerant. The low-temperature low-pressure two-phase refrigerant exchanges heat with the heat tranfers medium, such as water or brine, in the heat exchangers related to heat tranfers medium 25*a*-2 and 25*b*-2 by passing therethrough, and turns into a low-temperature low-pressure gas refrigerant. The low-temperature low-pressure gas refrigerant passes through each of the second refrigerant flow switching devices 28*a*-2 and 28*b*-2, is sent out from the sub relay unit 2*b*-2, is merged with the refrigerant that has been sent out from each sub relay units, flows through the main relay unit 2*a*, and is conveyed to the outdoor unit 1 through the refrigerant piping 4. Here, the second refrigerant flow switching devices 28*a* and 28*b* are switched to the cooling side. Further, the fourth expansion device 29-2 is totally closed. The low-temperature low-pressure refrigerant that has been conveyed to the outdoor unit 1 passes through the check valve 13*d*, is guided into the accumulator 19 by the first refrigerant flow switching device 11, and is returned to the compressor 1.

Figure 9:
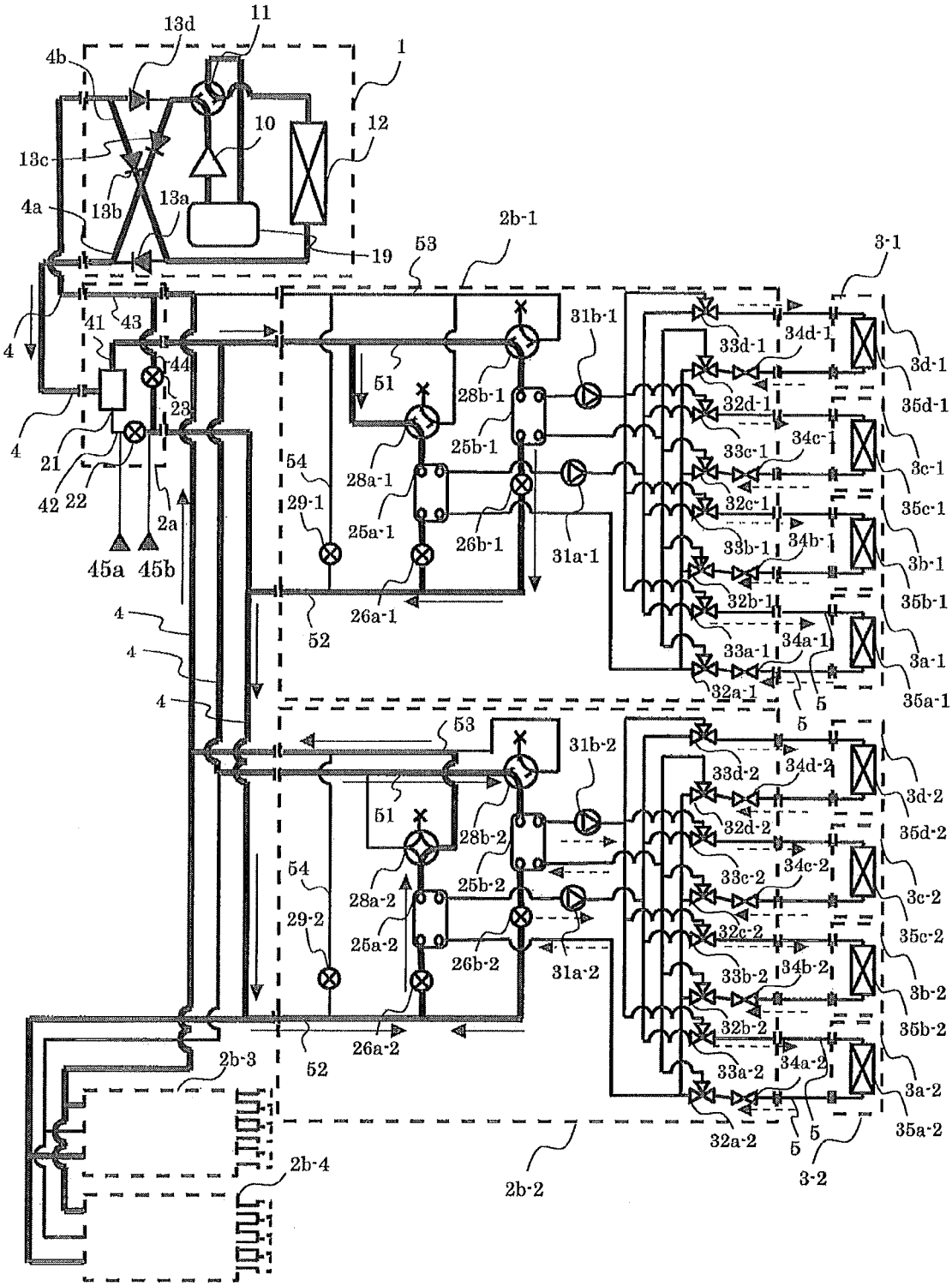
FIG. 9 Among the air-conditioning apparatuses according to Embodiment of the invention.

FIG. 9 is a system circuit diagram (refrigerant circuit diagram) illustrating the flows of the refrigerants in the heating main operation mode of the above air-conditioning apparatus. In the refrigerant circuit in FIG. 9, the circuit with thick lines shows the refrigerant flow during the heating main operation mode. In addition, the flow direction of the heat source side refrigerant is depicted with solid line arrows, and the flow direction of the heat tranfers medium is depicted with broken line arrows.

In FIG. 9, among the indoor units 3 that are connected to the sub relay units 2*b*-1, 2*b*-2, 2*b*-3, and 2*b*-4, the load of the indoor units 3 in the heating operation is sufficiently greater compared to the load of the indoor units 3 in the cooling operation mode, and all of the indoor units 3 that is connected to the sub relay unit 2*b*-1 is in heating operation and the indoor units 3 that is connected to the sub relay unit 2*b*-2 is in the mixed operation of the cooling operation and heating operation.

A low-temperature low-pressure refrigerant flows into the compressor 10 and is discharged as a high-temperature high-pressure gas refrigerant. The discharged high-temperature high-pressure refrigerant passes through the first refrigerant flow switching device 11 and the check valve 13*c*, flows through a refrigerant piping 4, and flows into the main relay unit 2*a*. The first refrigerant flow switching device 11 is switched such that the high-temperature high-pressure gas refrigerant discharged from the compressor 10 does not pass through the heat source side heat exchanger 12 in an outdoor unit 1 and is sent out from the outdoor unit 1. The high-temperature high-pressure liquid refrigerant that has flowed into the main relay unit 2*a* passes through the liquid side in the gas-liquid separator 21 and is sent out from the main relay unit 2*a*. Here, the first expansion device 22 is closed, and the opening degree of the second expansion device 23 is changed so that the pressure of the second pressure detection device 45*b* is constant. The gas refrigerant that has been sent out from the main relay unit 2*a* is supplied, among the sub relay units 2*b*, to the sub relay units 2*b* in which the connected indoor units 3 are undergoing heating operation, specifically the refrigerant is branched and supplied into 2*b*-1 and 2*b*-2. In the sub relay unit 2*b*-1 in which the connected indoor units 3 are only undergoing heating operation, gas refrigerant is supplied from the main relay unit 2*a*. The refrigerant passes through each of the second refrigerant flow switching devices

28*a*-1 and 28*b*-1 in the sub relay unit 2*b*-1 and exchanges heat with the heat tranfers medium, such as water or brine, in the heat exchangers related to heat tranfers medium 25*a*-1 and 25*b*-1 by passing therethrough. Here, the second refrigerant flow switching devices 25*a*-1 and 25*b*-1 are switched to the heating side. The refrigerant that has exchanged heat in the second refrigerant flow switching device with the heat tranfers medium and has turned into a high-temperature high-pressure liquid refrigerant, is expanded by passing through the third expansion devices 26*a*-1 and 26*b*-1, and is turned into a medium pressure liquid refrigerant. Each refrigerant that has been turned into a medium pressure liquid refrigerant in the third expansion devices 26*a*-1 and 26*b*-1 are merged, and a part of the refrigerant passes through a sub-unit second refrigerant passage 52 and is sent out from the sub relay unit 2*b*-1, and flows into the main relay unit 2*a*. Further, the remaining refrigerant is sent out to, among the other sub relay units, the sub relay units 2*b* in which the connected indoor units are undergoing cooling operation, specifically, refrigerant is sent out to the sub relay unit 2*b*-2 in FIG. 9. Here, the fourth expansion device 29-1 is totally closed. Note that the fourth expansion device 29 may be an on-off device, and during the heating main operation mode, the on-off device is closed.

In the sub relay unit 2*b*-2, the gas refrigerant that has been conveyed from the main relay unit 2*a* and the middle pressure liquid refrigerant that has been conveyed from the sub relay unit 2*b*-1 flow in. Among the refrigerant that has flowed in, the high-temperature high-pressure gas refrigerant that has been conveyed from the main relay unit 2*a* passes through the second refrigerant flow switching device 28*b*-2 and flows into the heat exchanger related to heat tranfers medium 25*b*-2. Here, the second refrigerant flow switching device 28*a*-2 is switched to the cooling side, and the second refrigerant flow switching device 28*b*-2 is switched to the heating side. The high-temperature high-pressure gas refrigerant that has flowed into the heat exchanger related to heat tranfers medium 25*b*-2 provides quantity of heat to the heat tranfers medium, such as water or brine, that has also flowed into the heat exchanger related to heat tranfers medium 25*b*-2, and turns into a high-temperature high-pressure liquid refrigerant. The refrigerant that has turned into a high-temperature high-pressure liquid is expanded by passing through the third expansion device 26*b*-2, and turns into a medium pressure liquid refrigerant. Here, the third expansion device 26*b*-2 is controlled so that the degree of subcooling of the refrigerant in the outlet of the heat exchanger related to heat tranfers medium 25*b*-2 becomes a target value. Additionally, the refrigerant that has tuned into a middle pressure liquid refrigerant merges with the middle pressure liquid refrigerant that has been conveyed from the sub relay unit 2*b*-1, passes through the third expansion device 26*a*-2, turns into a low-temperature low-pressure two-phase refrigerant, and flows into the heat exchanger related to heat tranfers medium 25*a*-2. The refrigerant receives quantity of heat from the heat tranfers medium, such as water or brine, that is also flowing into the heat exchanger related to heat tranfers medium 25*a*-2. Here, the third expansion device 26*a*-2, which the refrigerant passes through, is controlled so that the degree of superheat of the refrigerant that has passed through the heat exchanger related to heat medium 25*a*-2 and has exchanged heat becomes a target value. The low-temperature low-pressure two-phase refrigerant passes through the second refrigerant flow switching device 28*a*-2, merges with the low-temperature low-pressure refrigerant discharged from the other sub relay units 2*b*, flows through the main relay unit 2*a*, and is conveyed to the outdoor unit 1 through the refrigerant piping 4. Here, the fourth expansion device 29-2 is totally closed. The low-temperature low-pressure two-phase refrigerant that has been conveyed to the outdoor unit 1 passes through the check valve 13*b*, exchanges heat with the outdoor space 6 by passing through the heat source side heat exchanger 12 through the first refrigerant flow switching device 11, turns into a low-temperature low-pressure gas refrigerant, flows into the accumulator 19 guided by the first refrigerant flow switching device 11, and is returned to the compressor 10.

Note that although the above description has been made on the assumption that a gas-liquid separator to separate the gas phase and the liquid phase is provided, when using $CO_2$ as the heat source side refrigerant, $CO_2$ enters a supercritical state when in the high-pressure side, and when used as a gas cooler (condenser), it will be cooled to a supercritical state and will not turn into a two phase state in which gas phase and liquid phase is mixed. Accordingly, the gas-liquid separator for separating gas and liquid provided in the main relay unit 2*a* will not be required. Hence, when using $CO_2$ as a refrigerant, the same advantages can be obtained with the configuration of the invention without providing the gas-liquid separator.

As above, described in Embodiments, by connecting the outdoor unit 1 and the main relay unit 2*a*, the main relay unit 2*a* and at least one sub relay unit 2*b*, and each sub relay unit 2*b* and a plurality of indoor units 3, rather than refrigerant being conveyed, heat tranfers medium, such as water or brine, is conveyed indoors. With this, there will be no refrigerant leaking in rooms, and above that, by arranging the sub relay units 2*b* near the indoor units, conveyance power of the heat tranfers medium conveying device 31*a* and 31*b* can be reduced and, also, energy saving can be achieved.

Further, by arranging a plurality of sub relay units 2*b* to a single main relay unit 2*a*, it will be possible to introduce the refrigerant that has been separated into gas and liquid in the main relay unit 2*a* to the sub relay units 2*b*. Hence, according to the total heat load in the indoor units 3 that are connected to each sub relay units 2*b*, heat exchange between the heat tranfers medium and the refrigerant can be carried out and cooling operation and heating operation can be carried out at the same time. In this case, based on the total heat load of the sub relay units that is connected to the main relay unit, the operation mode of the outdoor unit may be determined.

Furthermore, since it is possible to connect a plurality of sub relay units 2*b*, it is possible to connect a plurality of indoor units 3 that is capable of operating individually.

REFERENCE SIGNS LIST

1. heat source device (outdoor unit); 2*a*. main relay unit; 2*b*-1, 2*b*-2, 2*b*-3, 2*b*-4. sub relay unit; 3, 3*a*, 3*b*, 3*c*, 3*d*. indoor unit; 4. refrigerant piping; 5. heat tranfers medium piping; 6. outdoor space; 7. indoor space; 8. space above a ceiling; 9. structure, such as a building; 10. compressor; 11. first refrigerant flow switching device; 12. heat source side heat exchanger; 13. check valve; 19. accumulator; 21. gas-liquid separator; 22. first expansion device (main-unit expansion device); 23. second expansion device (main-unit expansion device); 25*a*, 25*b*. heat exchanger related to heat tranfers medium; 25*a*-1, 25*b*-1, 25*a*-2, 25*b*-2. heat exchanger related to heat tranfers medium; 26*a*, 26*b*. third expansion device (sub-unit expansion device); 26*a*-1, 26*b*-1, 26*a*-2, 26*b*-2. third expansion device (sub-unit expansion device); 28*a*, 28*b*. second refrigerant flow switching device; 28*a*-1, 28*b*-1, 28*a*-2, 28*b*-2. second refrigerant flow switching device; 29, 29-1, 29-2. fourth expansion device (sub-unit expansion device); 31*a*, 31*b*. heat tranfers medium conveying device; 31*a*-1,31*b*-1, 31*a*-2, 31*b*-2. heat tranfers medium conveying device; 32*a*, 32*b*, 32*c*, 32*d*. heat tranfers medium flow switching device (outlet side); 32*a*-1, 32*b*-1, 32*c*-1, 32*d*-1. heat tranfers medium flow switching device (outlet side); 32*a*-2, 32*b*-2, 32*c*-2, 32*d*-2. heat tranfers medium flow switching device (outlet side); 33*a*, 33*b*, 33*c*, 33*d*. heat tranfers medium flow switching device (inlet side); 33*a*-1, 33*b*-1, 33*c*-1, 33*d*-1. heat tranfers medium flow switching device (inlet side); 33*a*-1, 33*b*-1, 33*c*-1, 33*d*-1. heat tranfers medium flow switching device (inlet side); 34*a*, 34*b*, 34*c*, 34*d*. heat tranfers medium flow control device; 34*a*-1, 34*b*-1, 34*c*-1, 34*d*-1. heat tranfers medium flow control device; 34*a*-2, 34*b*-2, 34*c*-2, 34*d*-2. heat tranfers medium flow control device; 35*a*, 35*b*, 35*c*, 35*d*. use side heat exchanger; 35*a*-1, 35*b*-1, 35*c*-1, 35*d*-1. use side heat exchanger; 35*a*-2, 35*b*-2, 35*c*-2, 35*d*-2. use side heat exchanger; 41. main-unit first refrigerant passage; 42. main-unit second refrigerant passage; 43. main-unit third refrigerant passage; 44. main-unit bypass passage; 45*a*. first pressure detection device; b5*a*. second pressure detection device; 51. sub-unit first refrigerant passage; 52. sub-unit second refrigerant passage; 53. sub-unit third refrigerant passage; 54. sub-unit bypass passage;

The invention claimed is:

1. An air-conditioning apparatus, comprising:

an outdoor unit including a compressor for compressing and conveying a refrigerant, a first refrigerant flow switching device for switching passages conveying the refrigerant, and a heat source side heat exchanger for exchanging heat between an air and the refrigerant;

a plurality of indoor units each including a use side heat exchanger for exchanging heat between air and a heat transfer medium, the heat transfer medium flowing in the use side heat exchangers; and a relay unit disposed between the outdoor unit and the indoor units, for exchanging heat between the refrigerant conveyed from the outdoor unit and the heat transfer medium, the relay unit including a main relay unit including a gas-liquid separator for separating the refrigerant conveyed from the outdoor unit into gas and liquid, a main-unit expansion device arranged at a liquid refrigerant outlet side passage from the gas-liquid separator and a returning refrigerant passage through which the refrigerant returning to the outdoor unit flows, the main relay unit being connected to the outdoor unit with refrigerant piping, and a plurality of sub relay units connected to the main relay unit through each of a gas refrigerant outlet side passage from the gas-liquid separator, the liquid refrigerant outlet side passage from the gas-liquid separator, and the returning refrigerant passage, the plurality of sub relay units including:

a plurality of heat exchangers related to heat medium each for exchanging heat between the refrigerant and the heat transfer medium;

a plurality of second refrigerant flow switching devices each for switching passages of the refrigerant conveyed from the main relay unit;

a plurality of sub-unit expansion devices respectively disposed in refrigerant passages corresponding with the heat exchangers related to heat transfer medium;

a plurality of heat transfer medium conveying devices each for conveying the heat transfer medium that has exchanged heat with the refrigerant in the corresponding heat exchanger related to heat transfer medium to the indoor units, which are connected to the plurality of heat transfer medium conveying devices through heat transfer medium piping;

a plurality of heat transfer medium flow switching devices each disposed in a counter position to the inlet side and outlet side of the corresponding indoor unit in which the heat transfer medium flows, the heat transfer medium flow switching devices each for selecting a passage of the heat transfer medium, which flows in the indoor unit, among the heat exchangers related to heat transfer medium; and a plurality of heat transfer medium flow control devices each disposed in a counter position to the inlet side or the outlet side of the corresponding indoor unit in which the heat transfer medium flows, the heat transfer medium flow control devices each controlling a flow rate of the heat transfer medium, wherein a first bypass passage is branched between the liquid refrigerant outlet side passage from the gas-liquid separator and the plurality of heat exchangers related to heat transfer medium and is connected to the returning refrigerant passage and a first bypass expansion device controlling amount of the refrigerant that flows through the first bypass passage is disposed on the first bypass passage.

2. The air-conditioning apparatus of claim 1, the plurality of sub relay units each further comprising:

a sub-unit first refrigerant passage communicating with the gas refrigerant outlet side passage;

a sub-unit second refrigerant passage communicating with the liquid refrigerant outlet side passage; and a sub-unit third refrigerant passage communicating with the returning refrigerant passage, wherein the sub-unit first refrigerant passage and the sub-unit second refrigerant passage are connected by a plurality of passages in which the second refrigerant flow switching devices, the heat exchangers related to heat transfer medium, and the sub-unit expansion devices respectively connect in series, each of the second refrigerant flow switching devices are configured to switch and connect the corresponding heat exchanger related to the heat transfer medium to the sub-unit first refrigerant passage or to the sub-unit third refrigerant passage.

3. The air-conditioning apparatus of claim 2, wherein a second bypass passage that has a second bypass expansion device connects between the sub-unit second refrigerant passage and the sub-unit third refrigerant passage for controlling amount of the returning refrigerant through the returning refrigerant passage.

4. The air-conditioning apparatus of claim 1, comprising:

a heating only operation mode in which all of the operating indoor units are carrying out heating operations;

a cooling only operation mode in which all of the operating indoor units are carrying out cooling operations; and a cooling and heating mixed operation mode in which, some indoor units are carrying out heating operations and some indoor units are carrying out cooling operations.

5. The air-conditioning apparatus of claim 4, wherein the cooling and heating mixed operation mode is a mode in which there is a mixture of heating operations and cooling operations in the indoor units connected to one of the plurality of sub relay units.

6. The air-conditioning apparatus of claim 4, wherein the cooling and heating mixed operation mode is a mode in which the indoor units connected to the plurality of sub relay units carry out heating operation and cooling operation per each of the plurality of sub relay units.

7. The air-conditioning apparatus of claim 4, wherein the operation mode of the outdoor unit is determined based on the total heat load of the sub relay units connected to the main relay unit.

8. The air-conditioning apparatus of claim 4, wherein each of the plurality of sub-unit expansion devices, in the heating only operation mode and the cooling and heating mixed operation mode, turn a refrigerant into a liquid refrigerant in middle pressure, the refrigerant flowing into the liquid refrigerant outlet side passage connected at outlet side of each of the plurality of sub-unit expansion devices after having become high pressure by the compressor and having passed the heat exchangers related to heat medium, and each of the plurality of sub-unit expansion devices, in the cooling only operation mode and the cooling and heating mixed operation mode, turn a liquid refrigerant in middle pressure into a gas-liquid two-phase in low pressure, the liquid refrigerant flowing into each of the plurality of sub-unit expansion devices from the liquid refrigerant outlet side passage.

* * * * *